US011661692B2

(12) United States Patent
Minematsu et al.

(10) Patent No.: US 11,661,692 B2
(45) Date of Patent: May 30, 2023

(54) SEWING MACHINE

(71) Applicant: BROTHER KOGYO KABUSHIKI KAISHA, Nagoya (JP)

(72) Inventors: Yoshihiro Minematsu, Nagoya (JP); Tsuneo Okuyama, Inabe-gun (JP); Mitsuhiro Iida, Gifu (JP); Kazutaka Imaizumi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 140 days.

(21) Appl. No.: 17/369,583

(22) Filed: Jul. 7, 2021

(65) Prior Publication Data

US 2022/0064834 A1 Mar. 3, 2022

(30) Foreign Application Priority Data

Aug. 31, 2020 (JP) ..... JP2020-145720

(51) Int. Cl.
*D05C 5/02* (2006.01)
*D05C 9/04* (2006.01)

(52) U.S. Cl.
CPC ..... *D05C 5/02* (2013.01); *D05C 9/04* (2013.01)

(58) Field of Classification Search
CPC ..... D05C 5/00–06; D05C 9/04; D05B 19/00–16; D05B 39/00
See application file for complete search history.

(56) References Cited

U.S. PATENT DOCUMENTS 4,823,714 A * 4/1989 Yokoe ..... D05B 19/08 112/475.05
5,791,270 A * 8/1998 Mori ..... G05B 19/408 112/102.5
2008/0264319 A1* 10/2008 Hayakawa ..... D05B 19/04 112/470.04
2009/0217850 A1* 9/2009 Tokura ..... D05B 21/00 112/102.5

(Continued)

FOREIGN PATENT DOCUMENTS

JP 2001017759 A 1/2001
JP 2008220670 A * 9/2008 ..... D05B 19/10
WO WO-2017110329 A1 * 6/2017 ..... D05B 19/08

*Primary Examiner* — Ismael Izaguirre
(74) *Attorney, Agent, or Firm* — Oliff PLC

(57) ABSTRACT

A sewing machine includes a sewing portion, a movement portion, a processor, and a memory. The memory is configured to store computer-readable instructions that, when executed by the processor, instruct the processor to perform processes. The processes include pattern acquisition processing of acquiring data relating to an embroidery pattern, first position information acquisition processing of acquiring first position information indicating a position of the holder when the holder is in a first position, second position information acquisition processing of acquiring second position information indicating a position of the holder when the holder is in a second position different from the first position, generating processing of generating sewing data for sewing the embroidery pattern re-shaped on the basis of the first position information and the second position information, and sewing control processing of controlling the sewing portion and the movement portion in accordance with the generated sewing data.

18 Claims, 12 Drawing Sheets

(56) References Cited

U.S. PATENT DOCUMENTS

| | | | | |
|---|---|---|---|---|
| 2010/0139538 | A1* | 6/2010 | Tashiro | D05B 19/10 112/102.5 |
| 2016/0215423 | A1* | 7/2016 | Kongo | D05B 19/12 |

* cited by examiner

SEWING MACHINE

CROSS-REFERENCE TO RELATED APPLICATION

This application claims priority to Japanese Patent Application No. 2020-145720 filed Aug. 31, 2020, the content of which is hereby incorporated herein by reference in its entirety.

BACKGROUND

The present disclosure relates to a sewing machine.

In a known sewing machine capable of embroidery sewing, a size of an embroidery pattern represented by sewing data can be adjusted in accordance with a scale factor input by a user.

SUMMARY

The user may adjust the size of the embroidery pattern using a design feature of a sewing object held by an embroidery frame, a decorative component such as a button, or the like, as an index. In this case, with the known sewing machine, it is necessary for the user to measure the size of the index using a ruler or the like, and to input a numerical value into the sewing machine in accordance with the measured size, which is complex.

Embodiments of the broad principles derived herein provide a sewing machine that improves convenience for a user, compared to known art, when re-shaping an embroidery pattern using a design feather or the like of a sewing object held in an embroidery frame as index.

Embodiments provide a sewing machine that includes a sewing portion, a movement portion, a processor, and a memory. The sewing portion includes a needle bar, the sewing portion is configured to form stitches on a sewing object by moving the needle bar up and down. The movement portion includes a holder on which an embroidery frame that holds the sewing object is detachably mounted, the movement portion is configured to move the holder with respect to the needle bar. The processor is configured to control the sewing portion and the movement portion. The memory is configured to store computer-readable instructions that, when executed by the processor, instruct the processor to perform processes. The processes include pattern acquisition processing of acquiring data relating to an embroidery pattern, first position information acquisition processing of acquiring first position information indicating a position of the holder when the holder is in a first position. The first position information is represented by a coordinate system of the movement portion. The processes include second position information acquisition processing of acquiring second position information indicating a position of the holder when the holder is in a second position different from the first position. The second position information is represented by the coordinate system of the movement portion. The processes include generating processing of generating sewing data for sewing the embroidery pattern re-shaped on the basis of the first position information and the second position information. The sewing data indicates positions of a plurality of needle drop points using the coordinate system of the movement portion. The processes include sewing control processing of controlling the sewing portion and the movement portion in accordance with the generated sewing data, and sewing the re-shaped embroidery pattern on the sewing object held by the embroidery frame.

BRIEF DESCRIPTION OF THE DRAWINGS

Embodiments will be described below in detail with reference to the accompanying drawings in which.

DETAILED DESCRIPTION

Figure 1:
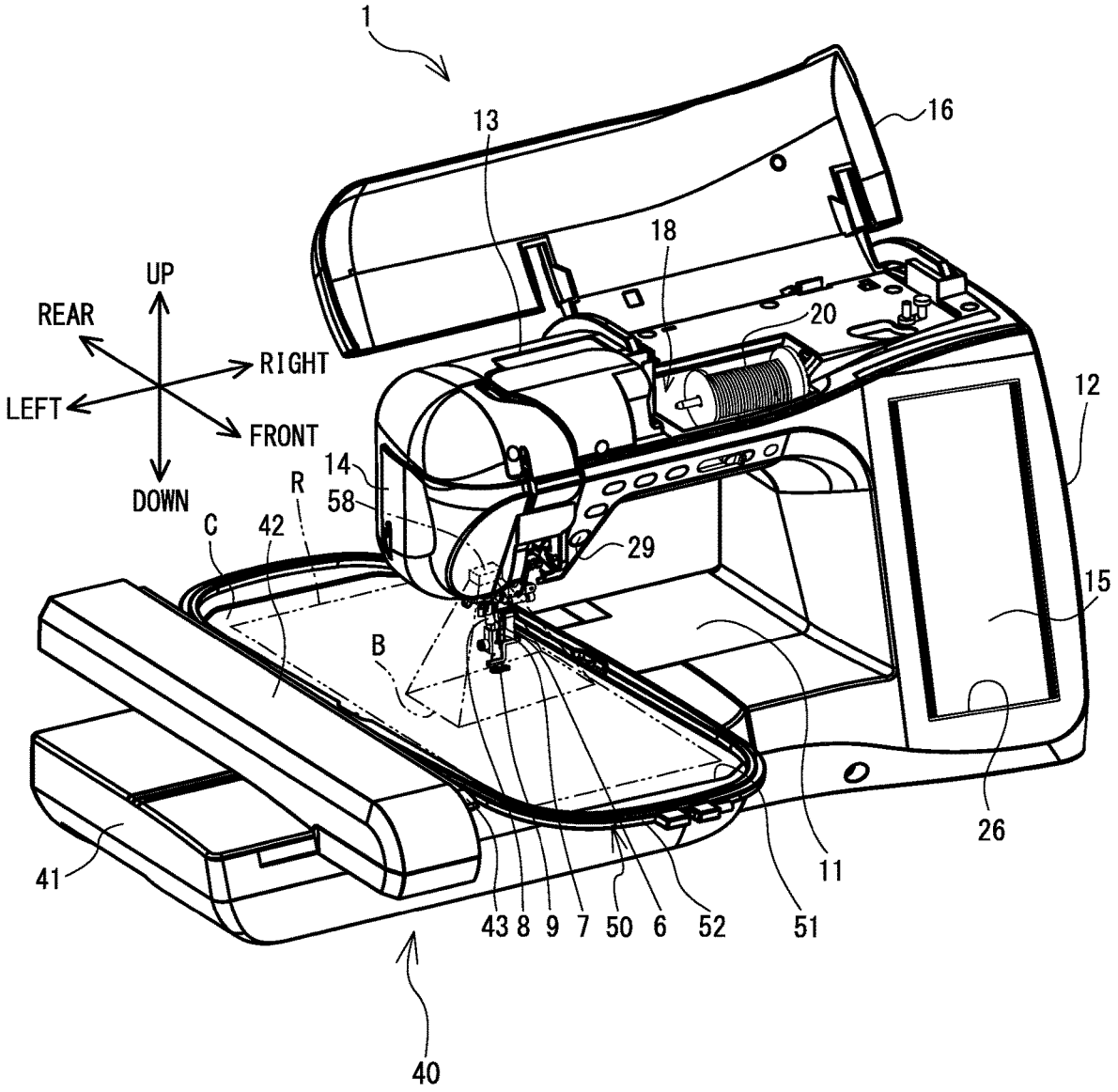
FIG. 1 is a perspective view of a sewing machine on which a movement portion is mounted.

First and second embodiments of the present disclosure will be explained sequentially with reference to the drawings. A physical configuration of a sewing machine 1 on which a movement portion 40 is mounted will be explained with reference to FIG. 1 and FIG. 2, the physical configuration of a sewing machine 1 is common to first and second embodiments. The up-down direction, the lower right side, the upper left side, the lower left side and the upper right side of FIG. 1 respectively correspond to the up-down direction, the front side, the rear side, the left side and the right side of the sewing machine 1 on which the movement portion 40 is mounted. The longitudinal direction of a bed portion 11 and an arm portion 13 is the left-right direction of the sewing machine 1, and the side on which a pillar 12 is disposed is the right side. The extending direction of the pillar 12 is the up-down direction of the sewing machine 1.

As shown in FIG. 1, the sewing machine 1 is provided with the bed portion 11, the pillar 12, the arm portion 13 and a head portion 14. The bed portion 11 is a base portion of the sewing machine 1 and extends in the left-right direction. The pillar 12 is provided so as to extend upward from the right end portion of the bed portion 11. The arm portion 13 faces the bed portion 11 and extends to the left from the upper end of the pillar 12. The head portion 14 is coupled to the left leading end portion of the arm portion 13.

Figure 2:
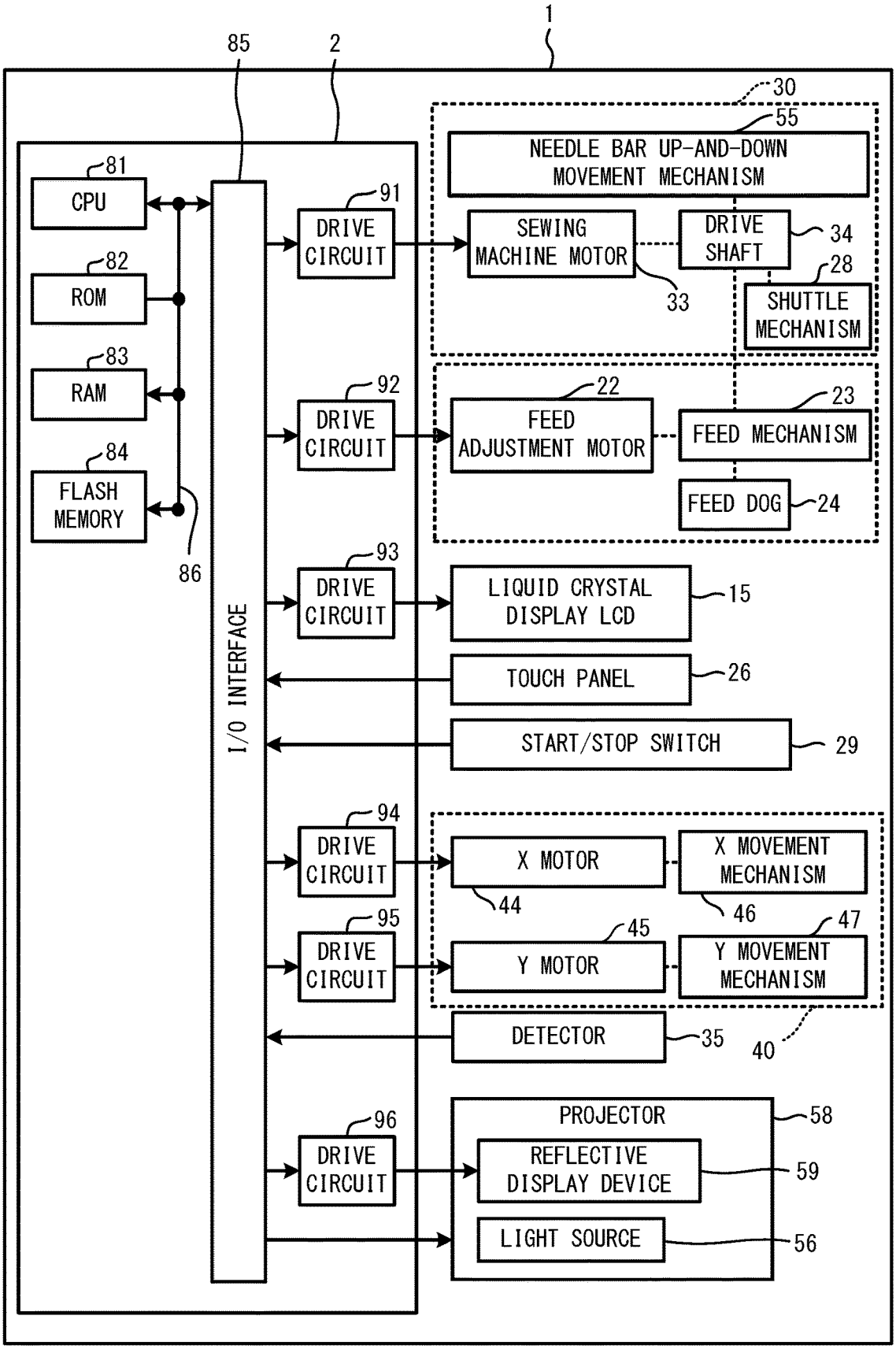
FIG. 2 is a block diagram showing an electrical configuration of the sewing machine.

The upper surface of the bed portion 11 is provided with a needle plate (not shown in the drawings). The needle plate includes a needle hole (not shown in the drawings) through which a sewing needle 7 to be described later is insertable. A feed dog 24, a feed mechanism 23, a shuttle mechanism 28 that are shown in FIG. 2 and the like are provided inside the bed portion 11 of the sewing machine 1. The feed dog 24 is driven by the feed mechanism 23 during normal sewing other than embroidery sewing, and moves a sewing object by a predetermined movement amount. The shuttle mechanism 28 entwines an upper thread (not shown in the drawings) with a lower thread (not shown in the drawings) below the needle plate.

An LCD 15 is provided in the front surface of the pillar 12. The LCD 15 displays an image including various items, such as commands, illustrations, setting values, messages and the like. A touch panel 26, which is configured to detect a depressed position, is provided on the front surface side of the LCD 15. When a user performs a pressing operation on the touch panel 26, using a finger or a stylus pen not shown in the drawings, the touch panel 26 detects the depressed position. A processor 2 (refer to FIG. 2) of the sewing machine 1 recognizes a selected item on the image, on the basis of the detected depressed position. Hereinafter, the pressing operation on the touch panel 26 by the user is referred to as a panel operation. Through the panel operation, the user can select an embroidery pattern that the user wants to sew, a command to be executed, and the like. A sewing machine motor 33 (refer to FIG. 2) is provided inside the pillar 12.

An upper portion of the arm portion 13 is provided with a cover 16 that can open and close. FIG. 1 shows a state in which the cover 16 is open. A thread housing portion 18 is provided below the cover 16, namely, inside the arm portion 13, when the cover 16 is in a closed state. The thread housing portion 18 can house a thread spool 20 around which the upper thread is wound. A drive shaft 34 (refer to FIG. 2) that extends in the left-right direction is provided inside the arm portion 13. The drive shaft 34 is driven to rotate by the sewing machine motor 33. Various switches, including a start/stop switch 29, are provided on a lower left portion of the front surface of the arm portion 13. The start/stop switch 29 starts or stops the operation of the sewing machine 1, namely, is used to input a sewing start command or a sewing stop command.

The head portion 14 is provided with a sewing portion 30 (refer to FIG. 2), a presser bar 8, a projector 58 and the like. The sewing portion 30 includes a needle bar 6, and is configured to form stitches on a sewing object C by moving the needle bar 6 up and down. The needle bar 6 is positioned above the needle hole. The sewing needle 7 is detachably mounted on the lower end of the needle bar 6. The sewing portion 30 further includes the drive shaft 34, and a needle bar up-and-down movement mechanism 55 that drives the needle bar 6 in the up-down direction as a result of the rotation of the drive shaft 34. A presser foot 9 is detachably mounted on the lower end portion of the presser bar 8. The presser foot 9 can move between a lowered position in which the presser foot 9 presses the sewing object C together with the presser bar 8, and a raised position in which the presser foot 9 is retracted upward from the lowered position, namely is separated from the sewing object C. The presser foot 9 intermittently presses the sewing object C downward, in synchronization with the up-and-down movement of the needle bar 6.

The projector 58 is configured to project a color image toward the bed portion 11. The projector 58 is provided with a cylindrical housing, a reflective display device 59 housed in the housing, a light source 56 (refer to FIG. 2) and an imaging lens (not shown in the drawings). The housing is fixed to a machine frame inside the head portion 14. The light source 56 is an LED. The reflective display device 59 modulates light from the light source 56, and forms an image light of a projected image on the basis of image data that represents the projected image. The imaging lens focuses the image light formed by the reflective display device 59 on the sewing object C held by an embroidery frame 50 mounted on a holder 43. An area onto which the projected image is projected is referred to as a projection area B. The projection area B includes a position below the needle bar 6, namely, a position corresponding to the needle hole. The projection area B is an area that is uniquely defined in accordance with an attachment position and an attachment posture of the projector 58, a distance from the imaging lens to the upper surface of the sewing object C, and the like. The projector 58 of the present embodiment projects the projected image onto the sewing object C and the bed portion 11 from diagonally above. Therefore, processing to correct image distortion is performed on the projected image. The size of the projection area B of the projector 58 of the present embodiment is stored in advance in a flash memory 84. The size of the projection area B is the number of dots of a long side and a short side of a rectangular area, for example.

The movement portion 40 is detachably mounted on the bed portion 11 of the sewing machine 1. The movement portion 40 is provided with a holder 43 a holder that is configured to mount with embroidery frame 50 configured to hold a sewing object C, and the movement portion 40 is configured to relatively move the holder 43 with respect to the needle bar 6. The single embroidery frame selected from among a plurality of types of embroidery frames including the embroidery frame 50, can be mounted on and removed from the movement portion 40. The embroidery frame 50 includes a first frame 51 and a second frame 52, and is configured to hold the sheet-shaped sewing object C with the first frame 51 and the second frame 52. The sewing object C is a work cloth, for example. The movement portion 40 is provided with a main body portion 41 and a carriage 42. The carriage 42 is provided with the holder 43, a Y movement mechanism 47 and a Y motor 45 shown in FIG. 2. The holder 43 is provided on the right side surface of the carriage 42. The embroidery frame 50 is configured to be mounted on and removed from the holder 43 provided on the carriage 42. The Y movement mechanism 47 causes the holder 43 to move in the front-rear direction, namely a Y direction. The Y motor 45 is configured to drive the Y movement mechanism 47. The main body portion 41 is internally provided with an X movement mechanism 46 and an X motor 44 shown in FIG. 2. The X movement mechanism 46 causes the carriage 42 to move in the left-right direction, namely an X direction. The X motor 44 is configured to drive the X movement mechanism 46. When embroidery sewing is performed using the embroidery frame 50, the movement portion 40 is configured to move the embroidery frame 50 mounted on the holder 43 of the carriage 42 to a position indicated by an XY coordinate system, namely an embroidery coordinate system, specific to the embroidery frame 50.

In the present embodiment, the right direction is defined as the X plus direction, and the rear direction is defined as the Y plus direction.

An electrical configuration of the sewing machine 1 that is common to first and second embodiments will be explained with reference to FIG. 2. A processor 2 of the sewing machine 1 is provided with a CPU 81, a ROM 82, a RAM 83, the flash memory 84 and an input/output (I/O) interface 85. The CPU 81 is connected to the ROM 82, the RAM 83, the flash memory 84 and the I/O interface 85, via a bus 86.

The CPU 81 performs overall control of the sewing machine 1 and performs various types of calculations and processing that relate to sewing, in accordance with various programs stored in the ROM 82. The ROM 82 is provided with a plurality of storage areas (not shown in the drawings) including a program storage area. The various programs including a program to execute main processing described later to operate the sewing machine 1 are stored in the program storage area.

The RAM 83 is provided with a storage area to store calculation results etc. obtained by the CPU 81 performing arithmetic processing. The flash memory 84 stores various parameters etc. for the sewing machine 1 to perform various types of processing. The flash memory 84 stores sewing data to sew various patterns that can be sewn by the sewing machine 1, for each of the plurality of patterns. The sewing data includes coordinate data. The coordinate data is data that indicates formation positions of the stitches, namely positions of the needle drop points, included in the pattern, using coordinates of the embroidery coordinate system. More specifically, the coordinate data includes a data group representing a plurality of coordinates of each of the needle drop points. The flash memory 84 further stores a correspondence between a type of the embroidery frame that can be mounted on the holder 43 and a sewing area. The sewing area is an area in which sewing is possible, and is set inside the embroidery frame mounted on the holder 43 of the sewing machine 1. The flash memory 84 of the present embodiment further stores a variable that associates the coordinates of the embroidery coordinate system with coordinates of a projection coordinate system that is a coordinate system of the projected image of the projector 58. Therefore, the sewing machine 1 can perform processing to identify the coordinates of the projection coordinate system, on the basis of the sewing data. For example, the sewing machine 1 can project the pattern represented by the sewing data onto a position at which the pattern is sewn on the sewing object C held by the embroidery frame 50. Drive circuits 91 to 96, the touch panel 26, the start/stop switch 29, the light source 56 of the projector 58 and a detector 35 are connected to the I/O interface 85. The light source 56 emits light in accordance with a control signal from the CPU 81, and projects the projected image displayed on the reflective display device 59 onto the sewing object that is to be moved on the bed portion 11. The detector 35 is configured to detect that the embroidery frame 50 has been mounted on the movement portion 40, and to output a detection result corresponding to the type of the embroidery frame. The detector 35 of the present embodiment is configured to detect the type of embroidery frame according to the ON and OFF combination of a plurality of mechanical switches.

The drive circuit 91 is connected to the sewing machine motor 33. The drive circuit 91 drives the sewing machine motor 33 in accordance with a control signal from the CPU 81. When the sewing machine motor 33 is driven, the needle bar up-and-down movement mechanism 55 is driven via the drive shaft 34 of the sewing machine 1, and the needle bar 6 moves up and down. The drive circuit 92 is connected to a feed adjustment motor 22. The drive circuit 93 drives the LCD 15 in accordance with a control signal from the CPU 81, and causes an image to be displayed on the LCD 15. The drive circuit 94 is connected to the X motor 44. The drive circuit 95 is connected to the Y motor 45. The drive circuits 94 and 95 drive the X motor 44 and the Y motor 45, respectively, in accordance with a control signal from the CPU 81. When the X motor 44 and the Y motor 45 are driven, the embroidery frame 50 mounted on the movement portion 40 moves in the left-right direction (the X direction) and the front-rear direction (the Y direction) by a movement amount corresponding to the control signal. The drive circuit 96 drives the reflective display device 59 in accordance with a control signal from the CPU 81, and causes the reflective display device 59 to project the projected image.

Operations of the sewing machine 1 will be explained briefly. When embroidery sewing is performed using the embroidery frame 50, the needle bar up-and-down movement mechanism 55 and the shuttle mechanism 28 are driven in combination with the embroidery frame 50 being moved in the X direction and the Y direction by the movement portion 40. Thus, an embroidery pattern is sewn on the sewing object C held by the embroidery frame 50, using the sewing needle 7 mounted on the needle bar 6.

Figure 6A:
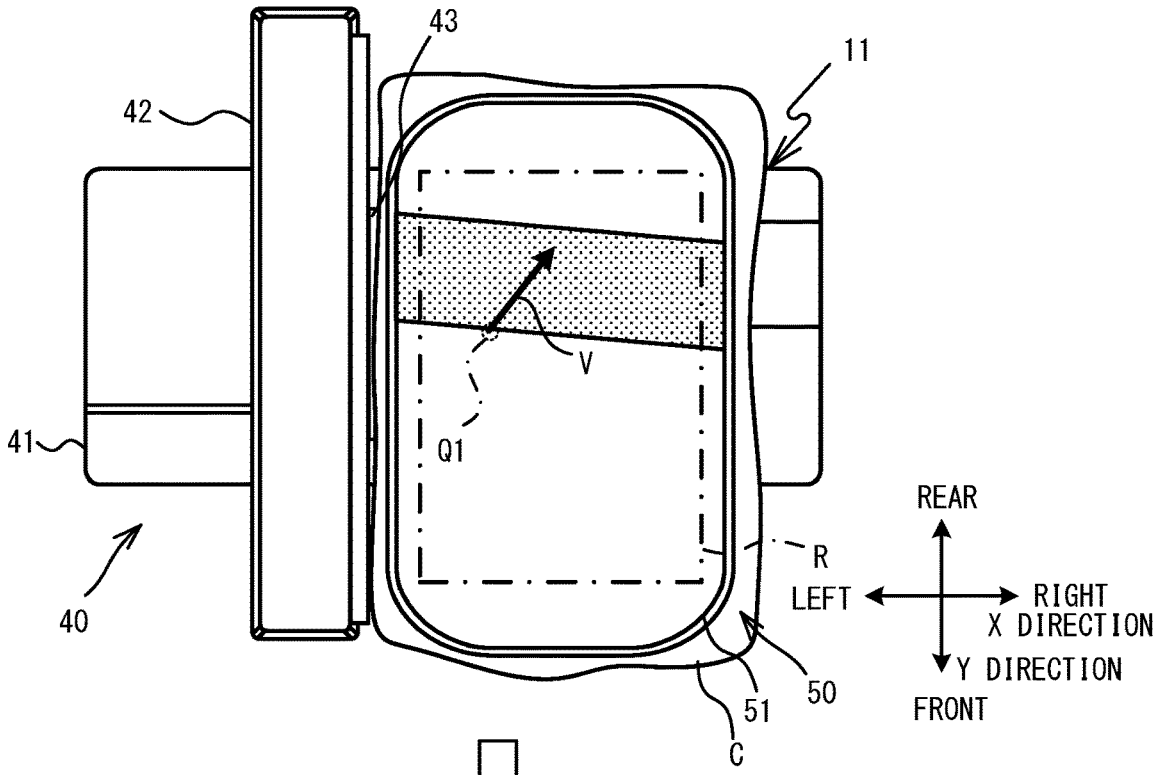
FIG. 6A is a schematic plan view of the movement portion when a holder is disposed in a first position and FIG. 6B is a schematic plan view of the movement portion when the holder is disposed in a second position.
Figure 6B:
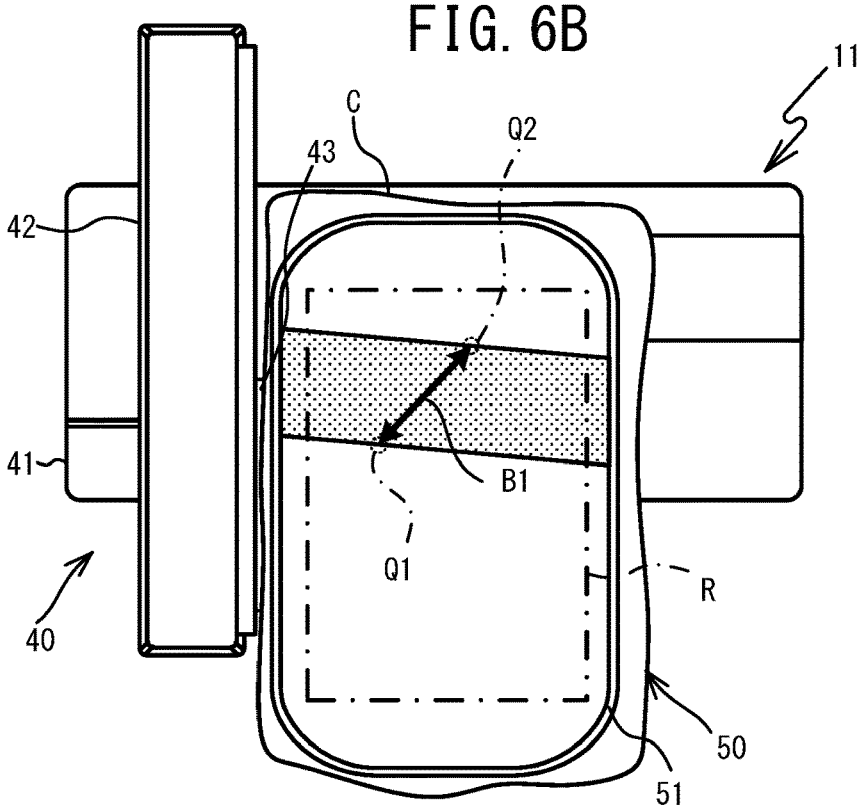
Figure 7:
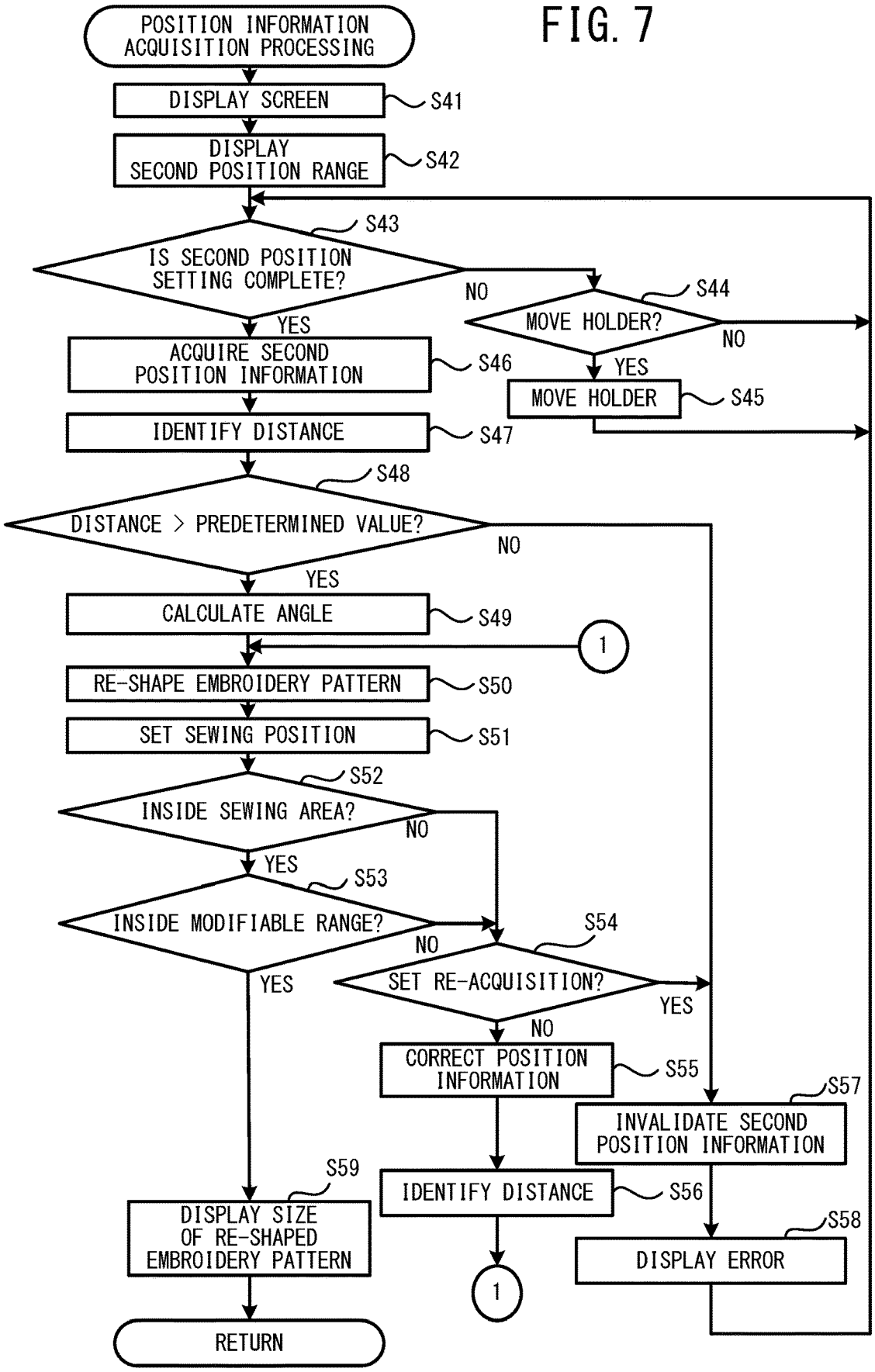
FIG. 7 is a flowchart of position information acquisition processing executed in the main processing shown in FIG. 3.
Figure 8:
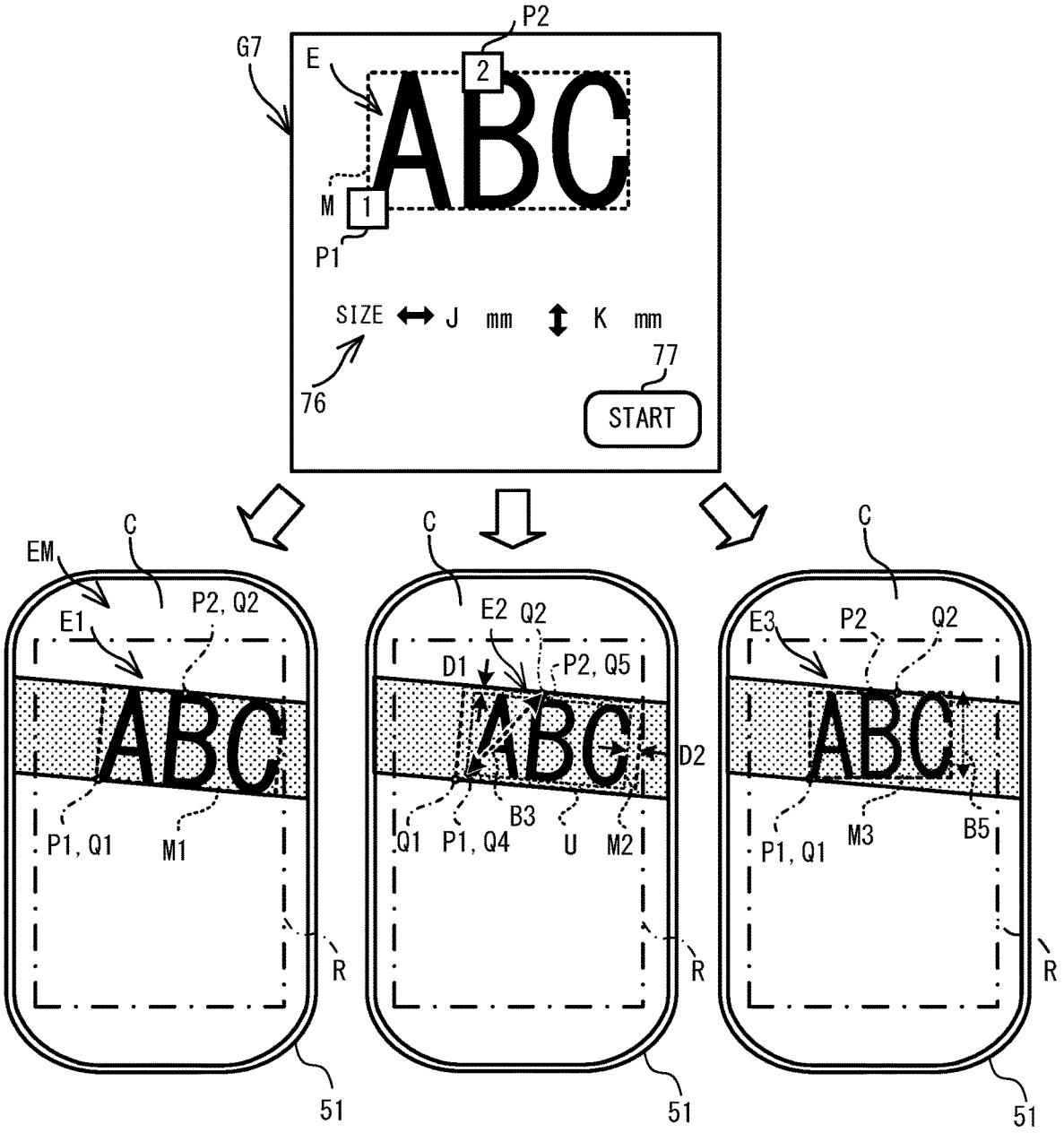
FIG. 8 is an explanatory diagram of a screen, and arrangements of an embroidery pattern with respect to a sewing area.

The main processing of the sewing machine 1 according to the first embodiment will be explained with reference to FIG. 3 to FIG. 8. In the main processing, the processor 2 generates the sewing data for sewing the embroidery pattern that has been re-shaped on the basis of position information indicating a position of the holder 43, and, in accordance with the generated sewing data, performs processing to sew the re-shaped embroidery pattern on the sewing object C held by the embroidery frame 50. The user selects one or more of the embroidery patterns to be sewn, from among a plurality of types of the embroidery patterns represented by the sewing data stored in advance in the flash memory 84 shown in FIG. 2, and inputs the start command to perform the main processing. When the processor 2 detects the start command, the processor 2 reads out, to the RAM 83, a program for executing the main processing that is stored in the program storage area of the ROM 82. The processor 2 performs the following steps in accordance with commands included in the program read out to the RAM 83. Various parameters necessary for performing the main processing are stored in the flash memory 84. Various data obtained in the course of the main processing are stored as needed in the RAM 83. In the following explanation, step is abbreviated as S. In FIG. 4 and FIG. 8, the left-right direction and the up-down direction on paper are, respectively, the X direction and the Y direction of the embroidery coordinate system, and indicate an arrangement of an embroidery pattern E. As first to third specific examples, the embroidery pattern E is used that represents the alphabet characters "ABC" shown in FIG. 4. The first to third specific examples are, respectively, examples in which embroidery patterns E1 to E3 shown in FIG. 8 are sewn. When no distinction is made between the re-shaped embroidery patterns E1 to E3, they are also referred to as an embroidery pattern EM.

Figure 3:
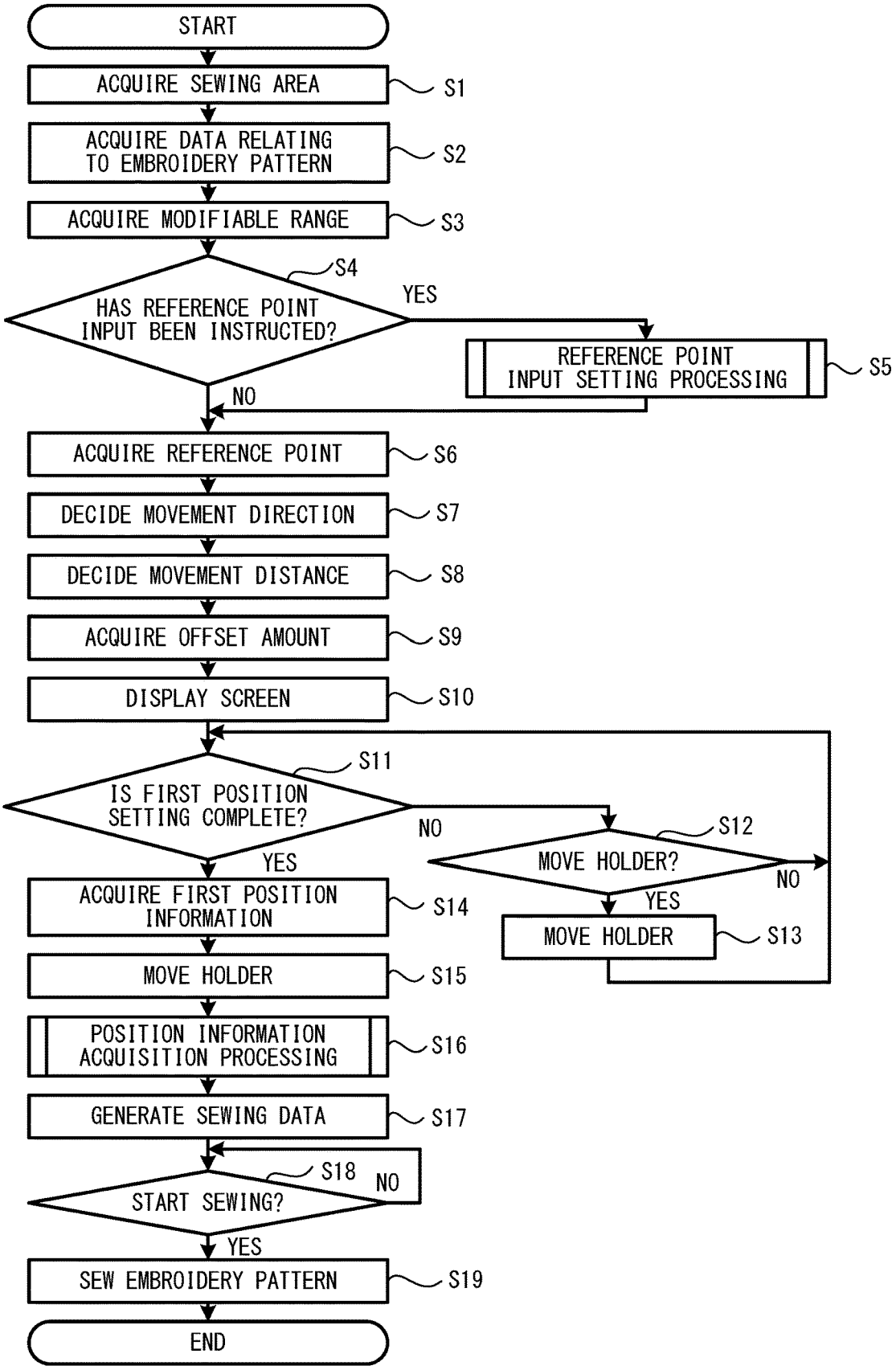
FIG. 3 is a flowchart of main processing.
Figure 4:
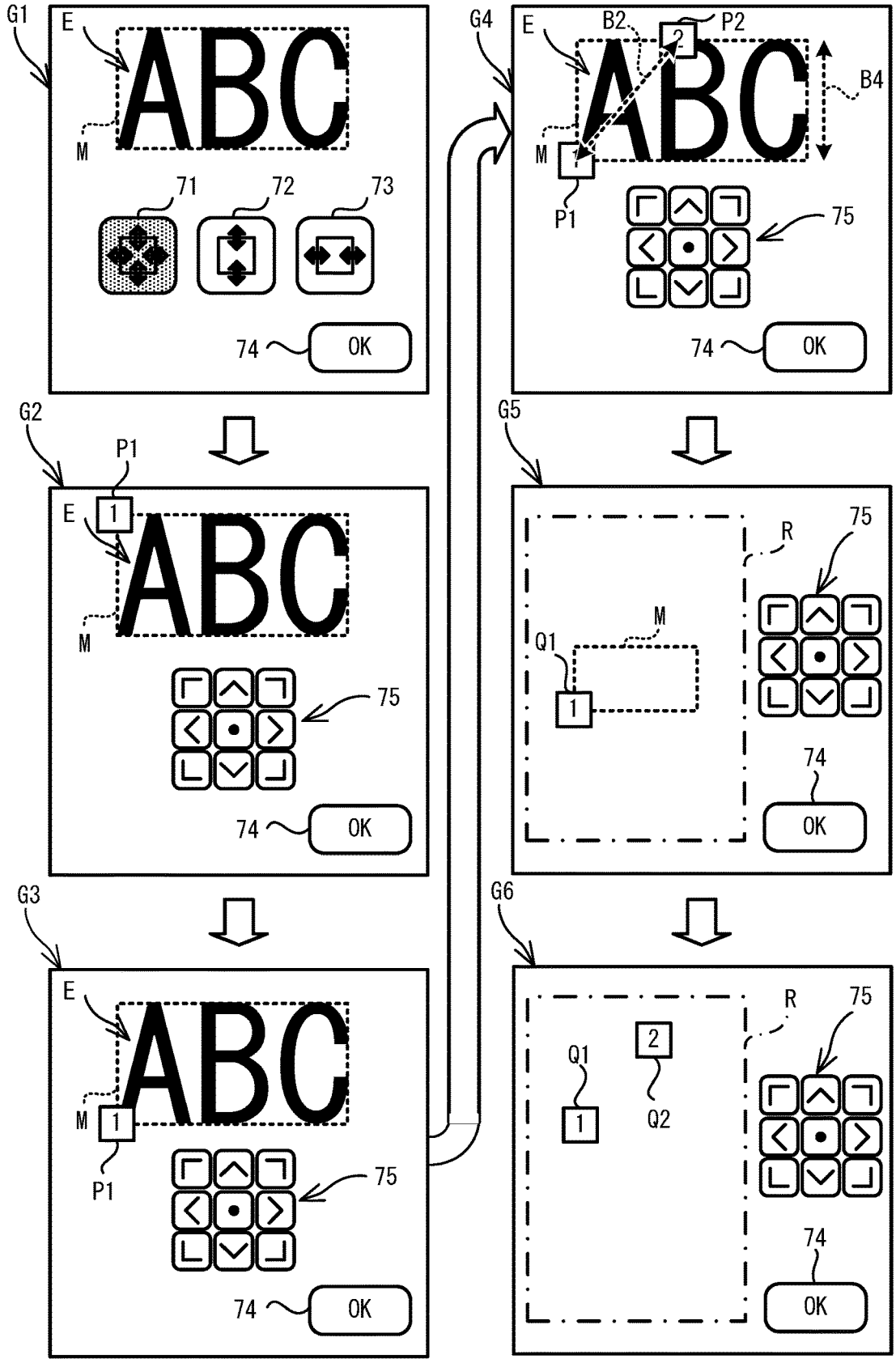
FIG. 4 is an explanatory diagram of screens displayed on an LCD in the main processing according to a first embodiment.

As shown in FIG. 3, the processor 2 acquires a size of a sewing area R set inside the embroidery frame 50 mounted on the holder 43 shown in FIG. 1 (S1). The processor 2 acquires the size of the sewing area R, for example, on the basis of the type of the embroidery frame 50 identified based on an output value of the detector 35, and on the basis of a correspondence between the type of the embroidery frame 50 and a size of the sewing area stored in the flash memory 84. A method for acquiring the size of the sewing area R may be changed as appropriate, and a value input by the user may be acquired, for example. The processor 2 detects the type of the embroidery frame 50, for example. The sewing area R is a rectangular shape having sides that extend in the X direction and in the Y direction of the embroidery coordinate system, and the size of the sewing area R is represented by a length in the X direction and in the Y direction in the embroidery coordinate system. For example, the length in the X direction is from 5 to 30 cm, and the length in the Y direction is from 5 to 30 cm. The sewing area R is larger than the projection area B.

As shown in FIG. 3, the processor 2 refers to the flash memory 84, and acquires data relating to the embroidery pattern E selected by the user (S2). The data relating to the embroidery pattern E is data representing the shape of the embroidery pattern E, and is, for example, graphic data representing the embroidery pattern E stored in the flash memory 84, or the sewing data for sewing the embroidery pattern E. The processor 2 may acquire the graphic data of the embroidery pattern drawing using a panel operation by the user, or may acquire the sewing data or the graphic data stored in an external device. In the first to third specific examples, the processor 2 acquires the sewing data for sewing the embroidery pattern E shown in FIG. 4. The processor 2 refers to the flash memory 84, and acquires a modifiable range associated with the embroidery pattern E acquired at S2 (S3). The modifiable range represents a tolerance amount when re-shaping the embroidery pattern E. The modifiable range is set in advance and is stored in a storage device, such as the flash memory 84. The modifiable range may be set to be common for a plurality of the embroidery patterns, or may be set individually for some or all of the plurality of embroidery patterns. The modifiable range may be set as appropriate in accordance with a re-shaping method of the embroidery pattern E. When the re-shaping method of the embroidery pattern E is enlarging or reducing the size of the embroidery pattern E, the modifiable range is represented by a magnification with respect to the initial size of the embroidery pattern E. The modifiable range is, for example, a range of a magnification of 0.8 to 1.2 with respect to the initial size of the embroidery pattern E.

The processor 2 determines whether a reference point input command has been detected (S4). The reference point input command is input by a panel operation via the touch panel 26 when the user sets a first reference point P1 and a second reference point P2. The first reference point P1 and the second reference point P2 are points set with respect to the embroidery pattern E acquired at S2, and are points used as references when re-shaping the embroidery pattern E. As will be described later with reference to FIG. 4, initial values of the first reference point P1 and the second reference point P2 are, for example, two points disposed at diagonally opposing corners of a mask M of the embroidery pattern E, and are stored in advance in the flash memory 84.

Figure 5:
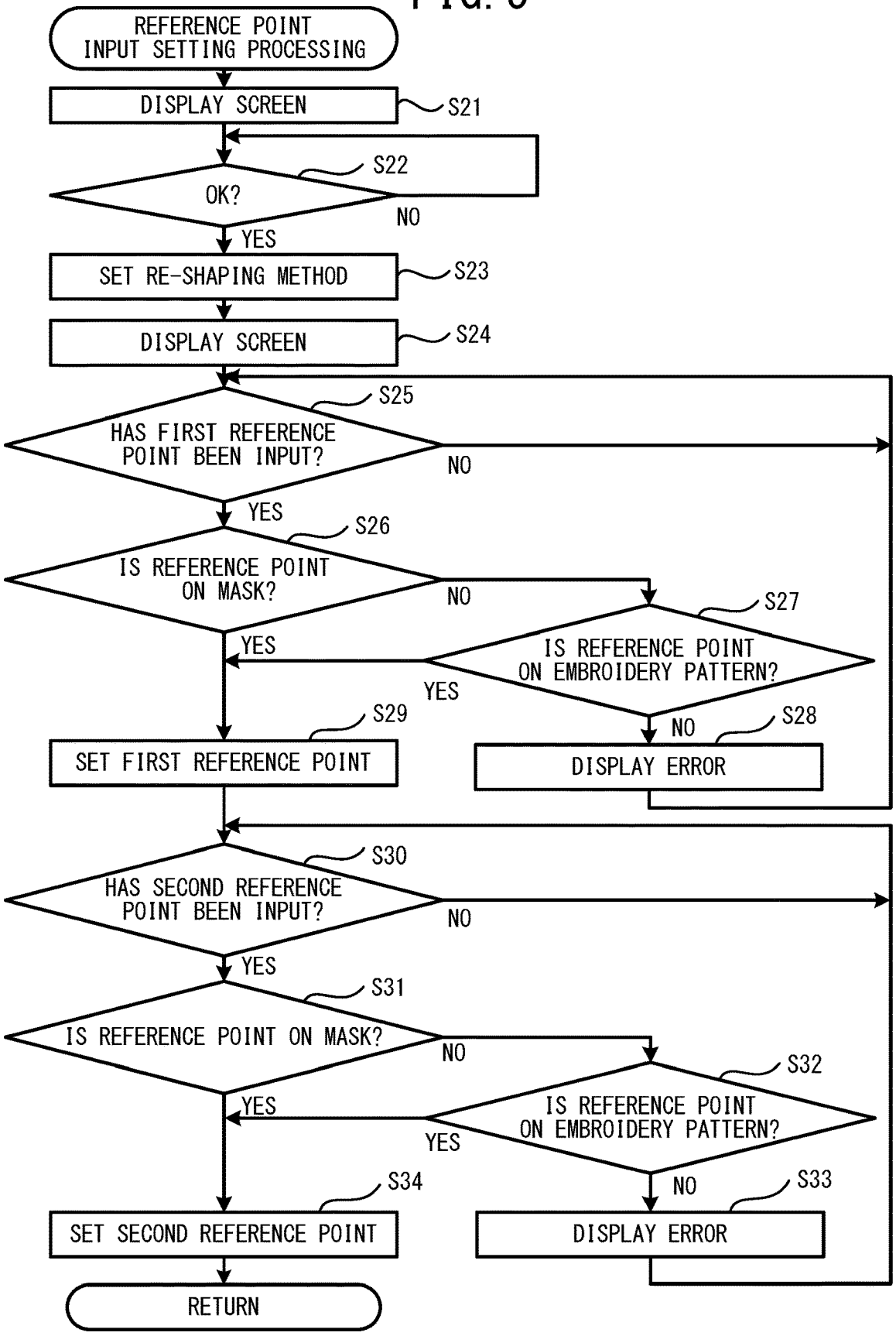
FIG. 5 is a flowchart of reference point input setting processing executed in the main processing shown in FIG. 3.

When the reference point input command has not been detected (no at S4), the processor 2 refers to the flash memory 84, and acquires the initial values of the first reference point P1 and the second reference point P2 (S6). When the reference point input command has been detected (yes at S4), the processor 2 performs reference point input setting processing (S5). In the present embodiment, each of the first reference point P1 and the second reference point P2 is set on the embroidery pattern E or on the mask M to be described later. Specifically, as shown in FIG. 5, in the reference point input setting processing, the processor 2 controls the drive circuit 93 to display, on the LCD 15, a screen G1 (refer to FIG. 4) for setting the re-shaping method of the embroidery pattern E acquired at S2 (S21). As shown in FIG. 4, the screen G1 displays the embroidery pattern E, the mask M, and keys 71 to 74. The mask M is a graphic representing the size of the embroidery pattern E. For example, the mask M includes two sides extending in the X direction and two sides extending in the Y direction, and is a minimum rectangle encompassing the embroidery pattern E. The keys 71 to 73 are keys for instructing the re-shaping method of the embroidery pattern E. Of the keys 71 to 73, the key that is currently selected is displayed in a different color to the other keys. The selected key on the screen G1 is the key 71. The key 71 is selected when a first method is set as the re-shaping method, in which the embroidery pattern E is enlarged or reduced in the X direction and the Y direction, and the embroidery pattern E is rotated by an angle calculated at S49 to be described later. The key 72 is selected when a second method is set as the re-shaping method, in which the embroidery pattern E is enlarged or reduced in the Y direction without being re-shaped in the X direction, and the angle of the embroidery pattern E is not changed. The key 73 is selected when a third method is set as the re-shaping method, in which the embroidery pattern E is enlarged or reduced in the X direction without being re-shaped in the Y direction, and the angle of the embroidery pattern E is not changed. The key 74 is selected when instructing the re-shaping method to be confirmed. Using a panel operation, the user selects the key 74 after selecting one selected from the group of the keys 71 to 73.

As shown in FIG. 5, the processor 2 determines whether the selection of the key 74 has been detected (S22). The processor 2 stands by until the selection of the key 74 is detected (no at S22). When the input of the key 74 has been detected (yes at S22), the processor 2 sets, of the first to the third method, the re-shaping method corresponding to the key selected by the user (S23). In the first and second specific examples, the first method is set as the re-shaping method, and in the third specific example, the second method is set as the re-shaping method.

The processor 2 controls the drive circuit 93 to display, on the LCD 15 shown in FIG. 1, a screen G2 shown in FIG. 4 for setting the first reference point P1 and the second reference point P2 (S24). As shown in FIG. 4, the screen G2 displays the embroidery pattern E, the mask M, the first reference point P1, the key 74, and keys 75. The embroidery pattern E, the mask M, and the key 74 are the same as on the screen G1. The first reference point P1 on the screen G2 represents the position of the first reference point P1 with respect to positions of the embroidery pattern E and the mask M. The center of the rectangular first reference point P1 corresponds to the position of the first reference point P1. The initial value of the first reference point P1 is, for example, the upper left corner of the mask M. The keys 75 are keys instructing directions, and, on the screen G2, the keys 75 are used to input a command to move the position of the first reference point P1 in the direction instructed by one selected from the group of the keys 75, by an amount by which the key 75 is depressed, that is, by an amount corresponding to a number of times the key 75 is depressed or a length of time that the key 75 is depressed. The key 74 is selected when instructing the input of the position of the reference point on the screen G2. The user selects the key 75, and, after changing the position of the first reference point P1 to the desired position, selects the key 74.

As shown in FIG. 5, the processor 2 determines whether the selection of the key 74 has been detected (S25). The processor 2 stands by until the selection of the key 74 is detected (no at S25). As shown by a screen G3 in FIG. 4, after the position of the first reference point P1 has been changed, when the selection of the key 74 has been detected (yes at S25), the processor 2 acquires a central position of the first reference point P1 as the position of the first reference point P1, and determines whether the acquired position of the first reference point P1 is on a side of the rectangle representing the mask M (S26). When the position of the first reference point P1 is not on the mask M (no at S26), the processor 2 determines whether the acquired position of the first reference point P1 is on the embroidery pattern E (S27). When the position of the first reference point P1 is not on the embroidery pattern E (no at S27), the processor 2 controls the drive circuit 93 to display an error message on the LCD 15 (S28), thus prompting the user to re-set the first reference point P1. The processor 2 returns the processing to S25. When the position of the first reference point P1 is on the mask M (yes at S26), or when the position of the first reference point P1 is on the embroidery pattern E (yes at S27), the processor 2 sets the first reference point P1 to the acquired position of the first reference point P1 (S29).

The processor 2 displays the second reference point P2 on the screen in the same manner as the screen G2. The user selects the key 75, and, after changing the position of the second reference point P2 to the desired position, selects the key 74. The processor 2 determines whether the selection of the key 74 has been detected (S30). The processor 2 stands by until the selection of the key 74 is detected (no at S30). When the selection of the key 74 is detected (yes at S30), the processor 2 acquires a center position of the second reference point P2 as the position of the second reference point P2, and determines whether the acquired position of the second reference point P2 is on the mask M (S31). When the position of the second reference point P2 is not on the mask M (no at S31), the processor 2 determines whether the acquired position of the second reference point P2 is on the embroidery pattern E (S32). When the position of the second reference point P2 is not on the embroidery pattern E (no at S32), the processor 2 controls the drive circuit 93 to display an error message on the LCD 15 (S33), thus prompting the user to re-set the second reference point P2. The processor 2 returns the processing to S30. When the position of the second reference point P2 is on the mask M (yes at S31), or when the position of the second reference point P2 is on the embroidery pattern E (yes at S32), the processor 2 sets the second reference point P2 to the acquired position of the second reference point P2 (S34). The processor 2 ends the reference point setting processing, and returns the processing to the main processing shown in FIG. 3. As a result of the reference point setting processing, the first reference point P1 and the second reference point P2 are set with respect to the embroidery pattern E, as shown by a screen G4 in FIG. 4, for example.

As shown in FIG. 3, following S5, the processor 2 acquires the first reference point P1 and the second reference point P2 set with respect to the embroidery pattern E using the touch panel 26 by the processing at S5 (S6). On the basis of the first reference point P1 and the second reference point P2 set on the embroidery pattern E, the processor 2 decides a movement direction of the holder 43 from a first position Q1 to be described later (S7). The movement direction is a direction with respect to a reference of a vector from the first reference point P1 toward a base point, in other words, is indicated by an angle. The base point is a point satisfying a condition that a distance from the base point to the second reference point P2 is shorter than a distance from the base point to the first reference point P1. The base point of the present embodiment is the second reference point P2, and the processor 2 decides the direction (the angle), with respect to the reference, of a vector from the first reference point P1 acquired at S6 toward the second reference point P2. The reference is, for example, the positive X direction, that is, the rightward direction. On the basis of the first reference point P1 and the second reference point P2 set on the embroidery pattern E, the processor 2 decides a movement distance of the holder 43 from the first position Q1 (S8). A method of deciding the movement distance may be established as appropriate in accordance with the movement direction set at S7. The movement distance may be a distance between the first reference point P1 and the base point, for example, and the processor 2 of the present embodiment decides, as the movement distance, a distance B2 (refer to FIG. 4) between first reference point P1 and the second reference point P2 acquired at S6 in the embroidery coordinate system, and the initial size of the embroidery pattern E represented by the sewing data.

The processor 2 acquires an offset amount (S9). The offset amount is a value used in processing to change the size of the embroidery pattern E acquired at S2, and in the present embodiment, prescribes an interval of a margin set on the outside of the mask M. The offset amount may be set for each of the four sides of the mask M, may be mutually different values for the two sides extending the X direction and the two sides extending in the Y direction, or may be a value that is common to the four sides of the mask M. In the first and third specific examples, the offset amount common to the four sides of the mask M is set to zero, and in the second specific example, the offset amount for the two sides extending in the X direction is set as D1, and the offset amount for the two sides extending in the Y direction is set as D2.

The processor 2 controls the drive circuit 93 to display, on the LCD 15, a screen G5 (refer to FIG. 4) for setting first position information (S10). The first position information indicates a position of the holder 43 represented by the coordinate system of the movement portion 40, when the holder 43 shown in FIG. 1 is at the first position Q1. In the present embodiment, the position of the holder 43 is represented by coordinates of the embroidery coordinate system indicating the position of the needle drop point with respect to the sewing area R. As shown in FIG. 4, the screen G5 displays the sewing region R, the first position Q1, and the keys 74 and 75. The keys 74 and 75 are the same as on the screen G2. The sewing area R represents a size of an area on which the sewing is possible, set inside the embroidery frame 50. The initial position of the first position Q1 is, for example, the position of the first reference point P1 when the embroidery pattern E is disposed in the initial position. The initial position of the embroidery pattern E is a position at which the center of the mask M of the embroidery pattern E is aligned with the center of the sewing area R. One selected from the group of the keys 75 is selected when instructing movement of the holder 43 on the screen G5. The key 74 is selected when instructing the completion of setting the position of the holder 43 on the screen G5.

The processor 2 determines whether the selection of the key 74 has been detected (S11). When the selection of the key 74 has not been detected (no at S11), the processor 2 determines whether the selection of the key 75 has been detected (S12). When the selection of the key 75 has been detected (yes at S12), the processor 2 controls the drive circuits 94 and 95 to move the holder 43 in the direction indicated by the selected key 75, by an amount detected (S13). When the selection of the key 75 has not been detected (no at S12), or after S13, the processor 2 returns the processing to S11. The user sets the first position Q1 using the needle drop point with respect to the sewing area R as a reference, for example. In other words, the user selects the key 75, and sets the first position Q1 by disposing an index, such as the design of the sewing object C held by the embroidery frame 50, to a position corresponding to the needle drop point, such as below the needle bar 6, for example. The processor 2 may control the projector 58 and may project a graphic indicating the needle drop point, such as a circle, for example, onto the sewing object C at a position corresponding to the needle drop point. The position corresponding to the needle drop may be a position of the needle drop point, or may be a predetermined position in the vicinity of the needle drop point. In this case, the user may dispose the index in the position corresponding to the needle drop point by disposing the index at the position of the projected needle drop point. As shown in FIG. 6A and FIG. 6B, in the first to third specific examples, the user uses a striped pattern, indicated by shading, in the sewing object C as the index, selects the key 75, and, after moving the holder 43 to a position indicated in FIG. 6A, selects the key 74. In FIG. 6A, the first position Q1 is indicated by the needle drop point when the holder 43 is at the first position Q1. When the selection of the key 74 has been detected (yes at S11), the processor 2 acquires the first position information indicating the position of the holder 43 represented by the embroidery coordinate system of the movement portion 40, when the holder 43 is at the first position Q1 (S14). The first position information is represented by coordinates (X1, Y1), of the embroidery coordinate system, of the needle drop point when the holder 43 is at the first position Q1, for example.

After acquiring the first position information at S14, and before acquiring second position information at step S16, the processor 2 controls the drive circuits 94 and 95 to move the holder 43 in the movement direction decided at S7 (S15). It is sufficient that a movement distance at S15 be set as appropriate, and may be, for example, the movement distance decided at S8. In the first to third specific examples, the holder 43 is moved in the movement direction and by the movement distance indicated by a vector V in FIG. 6A. When the holder 43 has moved by the movement distance decided at S8, or when a stop command has been acquired, the processor 2 controls the drive circuits 94 and 95 to stop the movement of the holder 43.

The processor 2 performs position information acquisition processing (S16). In the position information acquisition processing according to the first embodiment, processing to acquire the second position information is performed. As shown in FIG. 7, the processor 2 displays, on the LCD 15, a screen G6 (refer to FIG. 4) for setting the second position information (S41). The second position information indicates the position of the holder 43 indicated by the coordinate system of the movement portion 40, when the holder 43 is at a second position Q2. The second position Q2 is a position that is different from the first position Q1. As shown in FIG. 4, the screen G6 displays the sewing area R, the first position Q1, and the keys 74 and 75, in a similar manner to the screen G5, and also displays the second position Q2. The key 74 is selected when instructing completion of the setting of the second position Q2. The processor 2 controls the drive circuit 93 to display a second position range on the LCD 15 (S42). The second position range is an allowable range of the second position Q2 with respect to the first position Q1. The second position range of the present embodiment is the allowable range of the second position Q2, and is a range that satisfies both of the following first and second conditions. The first condition is a condition that a distance B1 between the first position Q1 and the second position Q2 is larger than a predetermined value referred to at S48. The predetermined value is established in advance, taking into account calculation of an angle of the embroidery pattern EM re-shaped using the first position Q1 and the second position Q2. The second condition is a condition that, when the embroidery pattern E acquired at S2 on the basis of the first position information and the second position information is re-shaped using the modifiable range acquired at S3, the entire re-shaped embroidery pattern EM is disposed inside the sewing area R. The processor 2 may control the drive circuit 96 to project the second position range onto the sewing object C using the projector 58.

The processor 2 determines whether the selection of the key 74 has been detected (S43). When the selection of the key 74 has not been detected (no at S43), the processor 2 determines whether the selection of the key 75 has been detected (S44). When the selection of the key 75 has been detected (yes at S44), the processor 2 controls the drive circuits 94 and 95 to move the holder 43 in the direction indicated by the selected key 75 by the detected amount (S45). When the selection of the key 74 has not been detected (no at S44), or after S45, the processor 2 returns the processing to S43. The user selects one of the keys 75, and, after causing the holder 43 to be moved to a position shown in FIG. 6B, selects the key 74. The user sets the second position Q2, for example, using the striped pattern of the sewing object C as the index. In FIG. 6B, the first position Q1 is indicated by the needle drop point when the holder 43 is at the first position Q1, and the second position Q2 is indicated by a needle drop point when the holder 43 is at the second position Q2. When the selection of the key 74 has been detected (yes at S43), the processor 2 acquires the second position information indicating the position of the holder 43 represented by the coordinate system of the movement portion 40, when the holder 43 is at the second position Q2 that is different from the first position Q1 (S46). The second position information is represented by coordinates (X2, Y2), of the embroidery coordinate system, of the needle drop point when the holder 43 is at the second position Q2, for example.

On the basis of the first position information acquired at S14 in FIG. 3, and the second position information acquired at S46 in FIG. 7, the processor 2 identifies the distance B1 between the first position Q1 and the second position Q2 (S47). The distance B1 is identified, using the first position information and the second position information, by a formula $\sqrt{((X2-X1)^2+(Y2-Y1)^2)}$. The processor 2 determines whether the distance B1 identified at S47 is larger than a predetermined value (S48). When the distance B1 identified at S47 is not larger than the predetermined value (no at S48), the processor 2 invalidates the second position information acquired at S46 (S57). The processor 2 deletes the second position information acquired at S46. The processor 2 controls the drive circuit 93 to display an error message on the LCD 15 (S58), thus prompting the user to re-set the second position Q2, and returns the processing to S43. In this way, when it is determined that the distance B1 is not larger than the predetermined value (no at S48), the processor 2 causes the second position information to be re-acquired. When the distance B1 identified at S47 is larger than the predetermined value (yes at S48), on the basis of the first position information acquired at S14 in FIG. 3 and the second position information acquired at S46 in FIG. 7, the processor 2 calculates the angle of the vector V (refer to FIG. 6A) from the first position Q1 toward the second position Q2, with respect to a reference direction (S49). The reference direction is, for example, the movement direction decided at S7. In other words, at S49, the angle of the vector V with respect to an initial angle of the embroidery pattern E acquired at S2 is calculated.

On the basis of the first position information and the second position information, the processor 2 re-shapes the embroidery pattern E acquired at S2 in FIG. 3 (S50). The processor 2 of the present embodiment re-shapes the embroidery pattern E acquired at S2, in accordance with the re-shaping method set at S23 in FIG. 5. The processor 2 enlarges or reduces the size of the embroidery pattern E acquired at S2, on the basis of the distance B1 identified at S47 and in the direction specified by the re-shaping method. When the offset amount acquired at S9 is zero, the processor 2 enlarges or reduces the embroidery pattern E in the direction specified by the re-shaping method such that the distance B2 between the first reference point P1 acquired at S29 in FIG. 5 and the second reference point P2 acquired at S34 is the same as the distance B1 between the first position Q1 and the second position Q2. When the offset amount acquired at S9 is not zero, the processor 2 enlarges or reduces the embroidery pattern E in the direction specified by the re-shaping method, on the basis of the first position information, the second position information, and the offset amount. Specifically, the processor 2 enlarges or reduces the embroidery pattern E in the direction specified by the re-shaping method, for example, such that the distance B2 between the first reference point P1 and the second reference point P2 is the same as a distance between a position identified using the first position information and a position identified using the second position information. The position identified using the first position information is a position from the first position Q1 further to the side of the center of the embroidery pattern E by the offset amount. The position identified using the second position information is a position from the second position Q2 further to the side of the center of the embroidery pattern E by the offset amount. When the re-shaping method is the first method, the embroidery pattern EM whose size has been changed is rotated by the angle calculated at S49.

The processor 2 sets a sewing position of the embroidery pattern EM re-shaped at S50 to a position in which the first reference point P1 is disposed at the position identified using the first position information and the second reference point P2 is disposed at the position identified using the second position information, respectively (S51). As in the first specific example, when the re-shaping method is the first method, and the offset amount is zero, the position identified using the first position information is the first position Q1, and the position identified using the second position information is the second position Q2. In other words, in the first specific example, the processor 2 sets the sewing position of the embroidery pattern E1 to a position in which the first reference point P1 is disposed at the first position Q1 and the second reference point P2 is disposed at the second position Q2. On the other hand, as in the second specific example, when the re-shaping method is the first method and the offset amount is not zero, the position identified using the first position information is a fourth position Q4 that is further to the side of the center of the embroidery pattern E2 from the first position Q1 by the offset amount. The position identified using the second position information is a fifth position Q5 that is further to the side of the center of the embroidery pattern E2 from the second position Q2 by the offset amount. Further, as in the third specific example, when the re-shaping method is the second method or the third method, the position identified using the first position information is a position on a straight line passing through the first position Q1 and extending in an orthogonal direction that is orthogonal to the direction specified by the re-shaping method in which the embroidery pattern E is enlarged or reduced. The orthogonal direction of the second method is the X direction, and the orthogonal direction of the third method is the Y direction. The position identified using the first position information may be the first position Q1. The position identified using the second position information is a position on a straight line passing through the second position Q2 and extending in the orthogonal direction. The position identified using the second position information may be the second position Q2.

When the embroidery pattern E is re-shaped on the basis of the first position information and the second position information, the processor 2 determines whether the re-shaped embroidery pattern EM fits within the sewing area R (S52). A known method may be adopted as appropriate for the determination at S52. When the embroidery pattern EM re-shaped at S50 is disposed in the sewing position set at S51, the processor 2 of the present embodiment determines whether the entire re-shaped embroidery pattern EM is disposed inside the sewing area R. When the entire re-shaped embroidery pattern EM is disposed inside the sewing area R (yes at S52), when the embroidery pattern E has been re-shaped on the basis of the first position information and the second position information, the processor 2 determines whether a modification amount of the re-shaped embroidery pattern EM fits within the modifiable range (S53). The processor 2 of the present embodiment determines whether the size of the embroidery pattern E has been enlarged or reduced at S50 using the modifiable range. When the entire re-shaped embroidery pattern EM is not disposed inside the sewing area R (no at S52), or when the modification amount is not within the modifiable range (no at S53), the processor 2 refers to the flash memory 84 and determines whether a re-acquisition setting of the second position information is stored (S54). In the present embodiment, when the conditions at S52 or S53 are not satisfied, whether or not to re-set the second position information can be set depending on whether the re-acquisition setting is stored in the flash memory 84. When the re-acquisition setting is stored (yes at S54), the processor 2 invalidates the second position information (S57), and, after displaying an error message on the LCD 15 (S58), returns the processing to S43. In this way, when it is determined that the re-shaped embroidery pattern EM does not fit within the sewing area R (no at S52), and when it is determined that the modification amount is not within the modifiable range (no at S53), respectively, the processor 2 causes the second position information to be re-acquired.

When the re-acquisition setting is not stored (no at S54), the processor 2 does not invalidate the second position information, and corrects at least one selected from the group of the first position information and the second position information (S55) such that the conditions at S52 and S53 are satisfied. When it is determined that the re-shaped embroidery pattern EM does not fit within the sewing area R (no at S52), when the embroidery pattern E has been re-shaped on the basis of the first position information and the second position information, at least one selected from the group of the first position information and the second position information is corrected such that the re-shaped embroidery pattern EM fits within the sewing area R. When it is determined that the modification amount is not within the modifiable range (no at S53), when the embroidery pattern E has been re-shaped on the basis of the first position information and the second position information, at least one selected from the group of the first position information and the second position information is corrected such that the modification amount of the re-shaped embroidery pattern EM is within the modifiable range. For example, the processor 2 corrects at least one selected from the group of the first position information and the second position information by moving at least one selected from the group of the first position Q1 and the second position Q2 to an arbitrary position on a line segment joining the first position Q1 and the second position Q2 such that a distance between the first position Q1 and the second position Q2 becomes shorter. The processor 2 identifies the distance B1 in the same manner as at S47 on the basis of the first position information and the second position information after S55 (S56), and returns the processing to S50. At S50 after S56, the processor 2 re-shapes the embroidery pattern E acquired at S2 in FIG. 3, on the basis of the first position information and the second position information after S55 (S50), and sets the sewing position on the basis of the first position information and the second position information after S55 (S51).

When it is determined that the modification amount is within the modifiable range (yes at S53), the processor 2 controls the drive circuit 93 to display, on the LCD 15, the size of the re-shaped embroidery pattern E when the embroidery pattern E has been re-shaped on the basis of the first position information and the second position information (S59). For example, the processor 2 displays a screen G7 shown in FIG. 8 on the LCD 15. The screen G7 displays the embroidery pattern E, the mask M, the first reference point P1, the second reference point P2, a field 76, and a key 77. The embroidery pattern E, the mask M, the first reference point P1, and the second reference point P2 are as the same as on the screen G3. The field 76 displays the size of the re-shaped embroidery pattern EM. With respect to the size of the embroidery pattern EM, for a minimum rectangle encompassing the re-shaped embroidery pattern EM, which includes two sides extending in the X direction and two sides extending in the Y direction, the length in the X direction is represented by J mm, and the length in the Y direction is represented by K mm. The key 77 is selected when inputting a command to start the sewing. The processor 2 here ends the position information acquisition processing and returns the processing to the main processing shown in FIG. 3.

The processor 2 generates the sewing data for sewing the embroidery pattern EM re-shaped on the basis of the first position information and the second position information, indicating the positions of a plurality of needle drop points using the embroidery coordinate system of the movement portion 40 (S17). The processor 2 generates the sewing data for sewing the re-shaped embroidery pattern EM by correcting the sewing data for sewing the embroidery pattern E acquired at S2, on the basis of the results at S50 and S51. A known method may be adopted as appropriate as a method for correcting the sewing data. The processor 2 may generate the sewing data for sewing the re-shaped embroidery pattern EM using the known method, on the basis of graphic data representing the embroidery pattern EM. The processor 2 determines whether the sewing start command has been detected (S18). The user inputs the sewing start command by selecting the key 77 or by pressing the start/stop switch 29. The processor 2 stands by until the sewing start command is detected (no at S18). When the sewing start command is detected (yes at S18), in accordance with the sewing data generated at S17, the processor 2 controls the sewing portion 30 and the movement portion 40, and sews the re-shaped embroidery pattern EM on the sewing object C held by the embroidery frame 50 (S19). The processor 2 ends the main processing.

As shown in FIG. 8, by the main processing, the embroidery pattern E1 in the first specific example is sewn on the sewing object C. The embroidery pattern E1 is the pattern rotated by the angle calculated at S49 after the embroidery pattern E is enlarged or reduced to a size indicated by a mask M1 such that the distance B2 and the distance B1 match each other. The first reference point P1 of the re-shaped embroidery pattern E1 is disposed at the first position Q1, and the second reference point P2 is disposed at the second position Q2.

In the second specific example, the embroidery pattern E2 is sewn on the sewing object C. The embroidery pattern E2 is rotated by the angle calculated at S49 after the embroidery pattern E is enlarged or reduced to a size indicated by a mask M2 such that the distance B2 and a distance B3 match each other. The distance B3 is a distance between the fourth position Q4 and the fifth position Q5. The first reference point P1 is disposed on the fourth position Q4 and the second reference point P2 is disposed on the fifth position Q5. A distance between the mask M2 and a rectangle U including four sides parallel to the four sides of the mask M2 and passing through the first position Q1 and the second position Q2 matches the offset amounts D1 and D2 acquired at S9.

In the third specific example, the embroidery pattern E3 is sewn on the sewing object C. The embroidery pattern E3 is obtained by enlarging or reducing the embroidery pattern E, in the Y direction, to a size indicated by a mask M3, such that a distance B4 (refer to FIG. 4) and a distance B5 match each other. The distance B4 is an absolute value of a difference between the Y coordinate of the first reference point P1 and the Y coordinate of the second reference point P2, and the distance B5 is an absolute value of a difference between the Y coordinate of the first position Q1 and the Y coordinate of the second position Q2.

Figure 9:
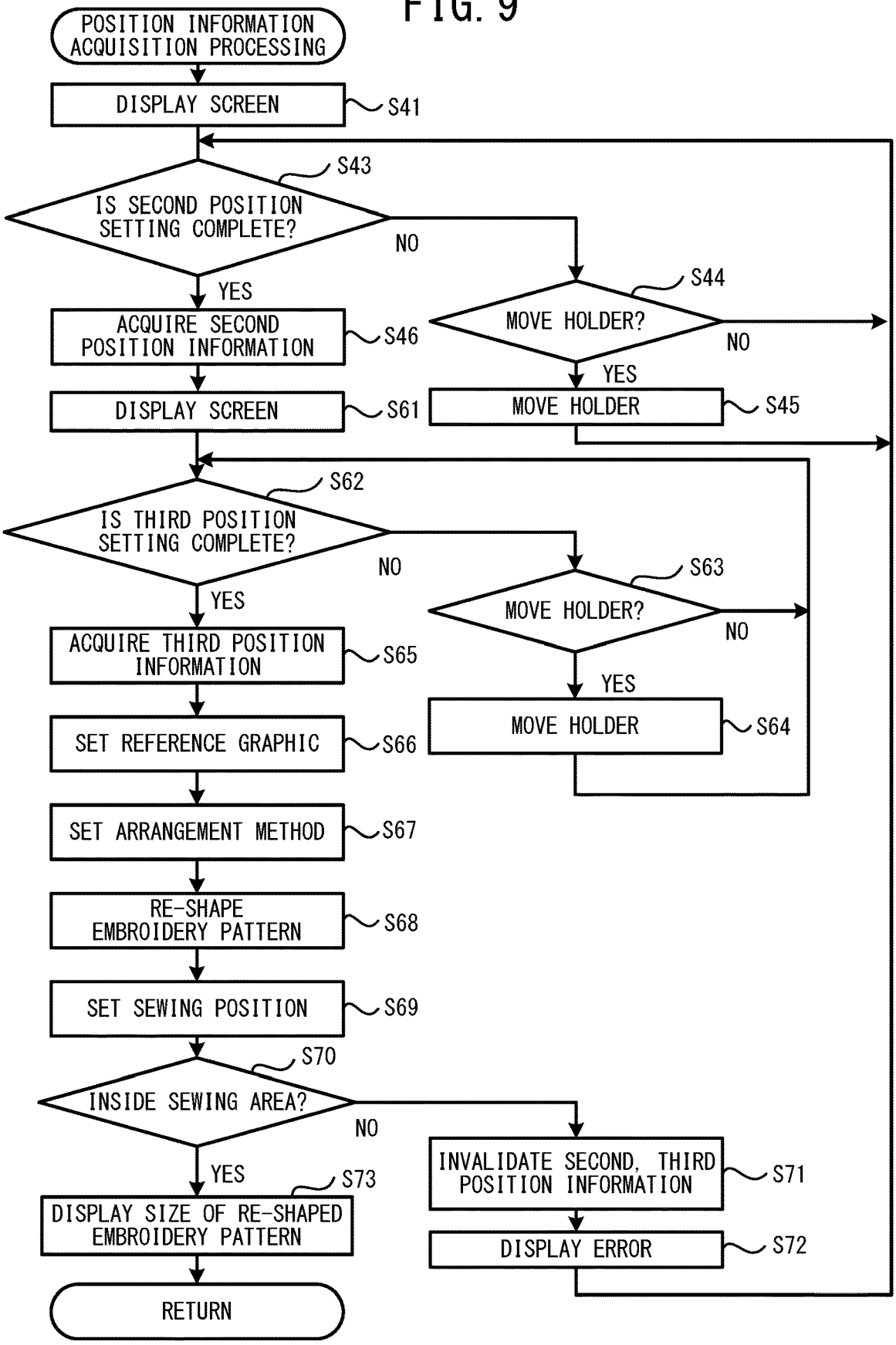
FIG. 9 is a flowchart of the position information acquisition processing according to a second embodiment.
Figure 10:
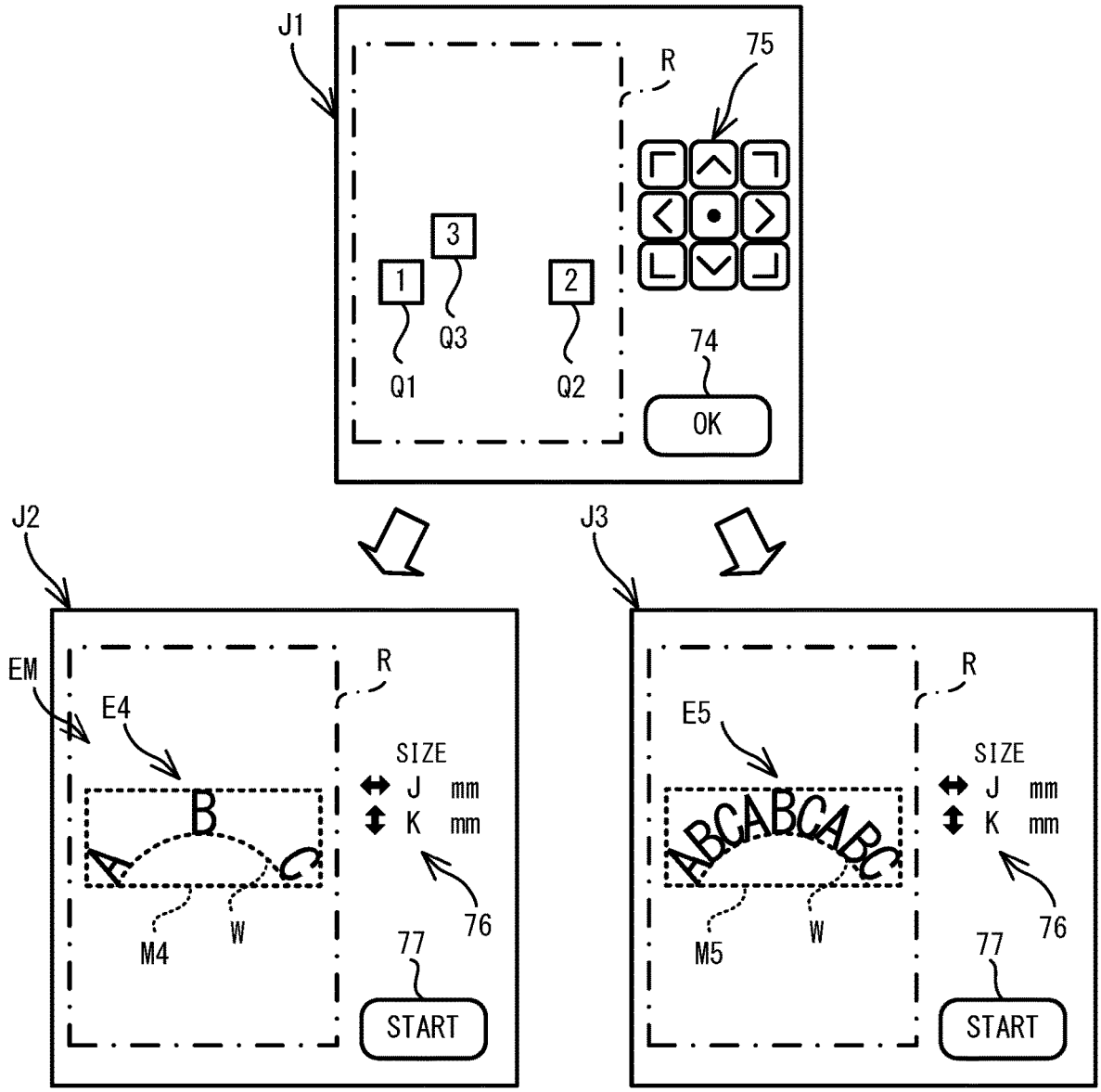
FIG. 10 is an explanatory diagram of screens displayed on the LCD in the main processing according to the second embodiment.

The main processing of the sewing machine 1 according to a second embodiment will be explained with reference to FIG. 9 and FIG. 10. The main processing according to the second embodiment differs from the main processing according to the first embodiment in that the processing from S3 to S9 is omitted, and the position information acquisition processing at S16, and S17 are different to the main processing according to the first embodiment, and the rest of the processing is the same as the first embodiment. In FIG. 9, the same step numbers are assigned to the processing of the position information acquisition processing that is the same as that of the first embodiment. As shown in FIG. 9, the position information acquisition processing according to the second embodiment differs from that of the first embodiment in that, in the position information acquisition processing according to the second embodiment, in place of the processing from S47 to S59, processing from S61 to S73 is performed. An explanation of the processing that is the same as that of the first embodiment will be omitted, and S61 to S73, and S17, which are different to the first embodiment, will be explained. Hereinafter, on the basis of the embroidery pattern E, in a similar manner to the first embodiment, a case in which an embroidery pattern E4 is sewn inside the sewing area R is a fourth specific example, and a case in which an embroidery pattern E5 is sewn is a fifth specific example. The main processing of the fourth and fifth specific examples are performed at different timings, respectively, but in order to simplify the explanation, they will be explained in parallel below. The main processing according to the second embodiment is activated when the user inputs a command to start editing of the embroidery pattern E. When the processor 2 detects the start command, the processor 2 reads out, to the RAM 83, a program for executing the main processing that is stored in the program storage area of the ROM 82. The processor 2 performs the following steps in accordance with commands included in the program read out to the RAM 83. In FIG. 10, the left-right direction and the up-down direction on paper are, respectively, the X direction and the Y direction of the embroidery coordinate system, and indicate an arrangement of the embroidery patterns E4 and E5. In a similar manner to the first embodiment, when no distinction is made between the re-shaped embroidery patterns E4 and E5, they are also referred to as the embroidery pattern EM.

In the position information acquisition processing according to the second embodiment, in addition to the first position information and the second position information, the processor 2 acquires third position information indicating the position of the holder 43 when the holder 43 is at a third position Q3 that is different from the first position Q1 and the second position Q2. Specifically, the processor 2 displays a screen J1, shown in FIG. 10, for setting the third position Q3 (S61). As shown in FIG. 10, the screen J1 includes the sewing area R, the keys 74 and 75, the first position Q1, the second position Q2, and the third position Q3. The keys 75 are selected when instructing the movement of the holder 43 on the screen J1. The key 74 is selected when instructing the completion of the setting of the position of the holder 43 on the screen J1. On the screen J1, the positions Q1 to Q3 are indicated by needle drop points when the holder 43 is in each of the positions.

The processor 2 determines whether the selection of the key 74 has been detected (S62). When the selection of the key 74 has not been detected (no at S62), the processor 2 determines whether the selection of the key 75 has been detected (S63). When the selection of the key 75 has been detected (yes at S63), the processor 2 controls the drive circuits 94 and 95 to move the holder 43 in the direction indicated by the selected key 75, by the detected amount (S64). When the selection of the key 75 has not been detected (no at S63), or after S64, the processor 2 returns the processing to S62. The user selects the key 75, and, after changing the third position Q3, selects the key 74. When the selection of the key 74 has been detected (yes at S62), the processor 2 acquires the third position information indicating the position of the holder 43 when the holder 43 is in the third position Q3 that is different from the first position Q1 and the second position Q2 (S65). The third position information is represented by coordinates (X3, Y3), of the embroidery coordinate system, of the needle drop point when the holder is at the third position Q3, for example.

The processor 2 sets a reference graphic on the basis of the first position information, the second position information, and the third position information (S66). The reference graphic is a graphic prescribed at three positions, and it is sufficient that the reference graphic be a graphic that can be used to re-shape the embroidery pattern E acquired at S2. The processor 2 sets a circular arc passing through needle drop points corresponding to each of the first position Q1, the second position Q2, and the third position Q3, as a reference graphic W. The processor 2 sets a method for arranging the embroidery pattern E with respect to the reference graphic W set at S66 (S67). A method of the present embodiment for arranging the embroidery pattern E with respect to the reference graphic W is a method in which the characters A, B, and C included in the embroidery pattern E are individually arranged as partial patterns, and one operation can be selected from left-aligned, right-aligned, centered, justified, and continuous arrangement, for example. The embroidery pattern E may include the sewing data for each of the partial patterns, for example. In the fourth specific example, "justified" is selected as the arrangement of the embroidery pattern E with respect to the reference graphic W, and in the fifth specific example, "continuous arrangement" is selected.

The processor 2 re-shapes the embroidery pattern E on the basis of the first position information, the second position information, and the third position information (S68). The processor 2 re-shapes the embroidery pattern E by arranging the embroidery pattern E, using the arrangement method set at S67, along the reference graphic W set at S66. The processor 2 sets the sewing position of the embroidery pattern EM re-shaped at S68 to a position in which the reference graphic W passes through the needle drop points corresponding to each of the first position Q1, the second position Q2, the third position Q3 (S69). In the fourth specific example, the embroidery pattern E is re-shaped and the sewing position of the embroidery pattern E4 is set as shown by the embroidery pattern E4 of a screen J2 shown in FIG. 10. The embroidery pattern E4 is a pattern in which the three alphabetic patterns included in the embroidery pattern E are arranged at equal intervals along the reference graphic W. In the fifth specific example, the embroidery pattern E is re-shaped and the sewing position of the embroidery pattern E5 is set as shown by the embroidery pattern E5 of a screen J3 shown in FIG. 10. The embroidery pattern E5 is a pattern in which the three alphabetic patterns included in the embroidery pattern E are continuously arranged at equal intervals and in three sets along the reference graphic W. The screens J2 and J3 include the reference graphic W, the sewing area R that is the same as on the screen G6 in FIG. 4, and the field 76 and the key 77 that are the same as on the screen G7 in FIG. 8. The field 76 is displayed by processing at S73 to be described later. The screen J2 includes the embroidery pattern E4 and a mask M4 of the embroidery pattern E4. The screen J3 includes the embroidery pattern E5 and a mask M5 of the embroidery pattern E5.

When the embroidery pattern EM re-shaped at S68 is arranged at the sewing position set at S69, the processor 2 determines whether the entire re-shaped embroidery pattern EM fits within the sewing area R (S70). When at least a part of the re-shaped embroidery pattern EM is not arranged inside the sewing area R (no at S70), the processor 2 invalidates the second position information acquired at S46 and the third position information acquired at S65 (S71). The processor 2 controls the drive circuit 93 to display an error message on the LCD 15 (S72), thus prompting the user to re-set the second position Q2 and the third position Q3, and returns the processing to S43. When the entire re-shaped embroidery pattern EM is arranged inside the sewing area R (yes at S70), the processor 2 controls the drive circuit 93 to display, on the LCD 15, the size of the re-shaped embroidery pattern EM (S73). In the fourth specific example, the processor 2 displays the size of the embroidery pattern E4 in the field 76 of the screen J2, and in the fifth specific example, the processor 2 displays the size of the embroidery pattern E5 in the field 76 of the screen J3. The processor 2 ends the position information acquisition processing according to the second embodiment, and returns the processing to the main processing that is the same as that of the first embodiment shown in FIG. 3.

At S17, the processor 2 generates the sewing data for sewing the embroidery pattern EM re-shaped on the basis of the first position information, the second position information, and the third position information, indicating the positions of a plurality of needle drop points using the coordinate system of the movement portion 40 (S17). The processor 2 generates the sewing data for sewing the re-shaped embroidery pattern EM by correcting the sewing data for sewing the partial patterns included in the embroidery pattern E acquired at S2, on the basis of the results at S67 and S68.

As shown in FIG. 1 and FIG. 2, the sewing machine 1 of the above-described first and second embodiments is provided with the sewing portion 30, the movement portion 40, and the processor 2. The sewing portion 30 includes the needle bar 6, and forms the stitches on the sewing object C by moving the needle bar 6 up and down. The movement portion 40 includes the holder 43 on which the embroidery frame 50 holding the sewing object C can be detachably mounted, and moves the holder 43 with respect to the needle bar 6. The processor 2 can control the sewing portion 30 and the movement portion 40. As shown in FIG. 3 and FIG. 4, the processor 2 acquires the data relating to the embroidery pattern E (S2). The processor 2 acquires the first position information indicating the position of the holder 43 when the holder 43 is at the first position Q1, using the coordinate system of the movement portion 40 (S14). The processor 2 acquires the second position information indicating the position of the holder 43 when the holder 43 is at the second position Q2 that is different from the first position Q1, using the coordinate system of the movement portion 40 (S46 in FIG. 7). The processor 2 generates the sewing data for sewing the embroidery pattern EM re-shaped on the basis of the first position information and the second position information, indicating the positions of the plurality of needle drop points using the embroidery coordinate system of the movement portion 40 (S17). In accordance with the sewing data generated at S17, the processor 2 controls the sewing portion 30 and the movement portion 40, and sews the re-shaped embroidery pattern EM on the sewing object C held by the embroidery frame 50 (S19). In the sewing machine 1, the user can cause the sewing machine 1 to acquire the first position information and the second position information by causing the holder 43 to be moved to the first position Q1 and to the second position Q2 in accordance with the index, which is the design or the like of the sewing object C held by the embroidery frame 50. The sewing machine 1 can generate the sewing data for sewing the embroidery pattern EM re-shaped on the basis of the first position information and the second position information. Thus, when the user re-shapes the embroidery pattern E using the index, it is not necessary for the user to measure the size of the index using a ruler or the like and to input, into the sewing machine 1, a numerical value depending on the measured size. As a result, the sewing machine 1 can improve convenience for the user compared to known art when re-shaping the embroidery pattern E using the design or the like of the sewing object C held by the embroidery frame 50 as the index.

The processor 2 of the sewing machine 1 according to the first embodiment identifies the distance B1 between the first position Q1 and the second position Q2 on the basis of the first position information and the second position information (S47 in FIG. 7). The processor 2 generates the sewing data for sewing the embroidery pattern EM re-shaped by enlarging or reducing the size of the embroidery pattern E on the basis of the distance B1 identified at S47 (S50 in FIG. 7, S17 in FIG. 3). When the user enlarges or reduces the size of the embroidery pattern E using the index, it is not necessary for the user to measure the size of the index using a ruler or the like and to input, into the sewing machine 1, a numerical value depending on the measured size. As a result, the sewing machine 1 can improve convenience for the user compared to known art when enlarging or reducing the size of the embroidery pattern E using the design or the like of the sewing object C held by the embroidery frame 50 as the index.

The processor 2 of the sewing machine 1 according to the first embodiment acquires the first reference point P1 and the second reference point P2 set with respect to the embroidery pattern E (S29, S34 in FIG. 5). The processor 2 generates the sewing data for sewing the embroidery pattern EM re-shaped by enlarging or reducing the embroidery pattern E such that the distance B2 between the acquired first reference point P1 and second reference point P2 becomes the same as the distance B1 between the first position Q1 and the second position Q2 (S50, S17). The user can set the distance B2 between the first reference point P1 and the second reference point P2 using the first position Q1 and the second position Q2. The sewing machine 1 can enlarge and reduce the embroidery pattern E using relatively simple processing using the distance B1 and the distance B2.

The sewing machine 1 according to the first embodiment is provided with the LCD 15 and the touch panel 26. The touch panel 26 receives the setting of the first reference point P1 and the second reference point P2 with respect to the embroidery pattern E displayed on the LCD 15. The processor 2 acquires the first reference point P1 and the second reference point P2 set with respect to the embroidery pattern E using the touch panel 26 (S29, S34). The user can set two desired points as the first reference point P1 and the second reference point P2, and can set the distance B2 between the set first reference point P1 and second reference point P2. Thus, compared to a case in which the user cannot set the first reference point P1 and the second reference point P2 with respect to the embroidery pattern E, the sewing machine 1 can improve convenience for the user when enlarging or reducing the size of the embroidery pattern E using the design or the like of the sewing object C held by the embroidery frame 50 as the index.

Each of the first reference point P1 and the second reference point P2 of the sewing machine 1 according to the first embodiment is set on the embroidery pattern E (S29, S34). The user can set two desired points on the embroidery pattern E formed by stitches as the first reference point P1 and the second reference point P2, and can set the distance B2 between the set first reference point P1 and second reference point P2. Thus, compared to a case in which the user cannot set, on the embroidery pattern E, the first reference point P1 and the second reference point P2 with respect to the embroidery pattern E, the sewing machine 1 can improve convenience for the user.

The processor 2 of the sewing machine 1 according to the first embodiment acquires the sewing area R set on the inside of the embroidery frame 50 (S1). When the embroidery pattern E is re-shaped on the basis of the first position information and the second position information, the processor 2 determines whether the re-shaped embroidery pattern EM fits within the sewing area R (S52). When it is determined that the re-shaped embroidery pattern EM does not fit within the sewing area R (no at S52), the processor 2 causes the second position information to be re-acquired (S46 after S57). The sewing machine 1 can improve the possibility that the embroidery pattern EM re-shaped on the basis of the first position information and the second position information will fit within the sewing area R.

When it is determined that the re-shaped embroidery pattern EM does not fit within the sewing area R (no at S52), the processor 2 of the sewing machine 1 according to the first embodiment generates the sewing data for sewing the embroidery pattern EM re-shaped to fit within the sewing area R on the basis of the first position information and the second position information (S55, S17). The sewing machine 1 can improve the possibility that the embroidery pattern EM re-shaped on the basis of the first position information and the second position information will fit within the sewing area R. The sewing machine 1 can eliminate the time and effort for the user to re-set at least one selected from the group of the first position Q1 and the second position Q2.

There is a case in which the user wishes to re-shape the embroidery pattern E by offsetting the embroidery pattern E by the offset amount from the index that is the design or the like of the sewing object C held by the embroidery frame 50. With respect to this, the processor 2 of the sewing machine 1 according to the first embodiment acquires the offset amount (S9). As in the second specific example, the processor 2 generates the sewing data for sewing the embroidery pattern EM re-shaped by enlarging or reducing the size of the embroidery pattern E on the basis of the first position information, the second position information, and the offset amount (S50, S17). As a result, compared to a case in which the sewing data for sewing the embroidery pattern EM re-shaped on the basis of the offset amount cannot be generated, the sewing machine 1 can improve convenience for the user when enlarging or reducing the embroidery pattern E using the design or the like of the sewing object C held by the embroidery frame 50 as the index.

The processor 2 of the sewing machine 1 according to the first embodiment decides the movement direction of the holder 43 from the first position Q1 on the basis of the first reference point P1 and the second reference point P2 set on the embroidery pattern E (S7). The processor 2 controls the movement portion 40 after acquiring the first position information and before acquiring the second position information, and moves the holder 43 in the decided movement direction (S15). In a state in which the holder 43 has been moved to the first position Q1, the user causes the holder 43 to be moved to the second position Q2 after causing the sewing machine 1 to acquire the first position information. Compared to a case in which, after acquiring the first position Q1, the holder 43 cannot be automatically moved in the movement direction before acquiring the second position information, the sewing machine 1 can reduce a time period until the second position information is acquired after the first position information has been acquired, and can improve convenience for the user when causing the holder 43 to be moved to the second position Q2.

The processor 2 according to the first embodiment decides the movement distance of the holder 43 from the first position Q1 on the basis of the first reference point P1 and the second reference point P2 set on the embroidery pattern E (S8). The processor 2 moves the holder 43 by the decided movement distance and in the decided movement direction after acquiring the first position information and before acquiring the second position information (S15). In the state in which the holder 43 has been moved to the first position Q1, the user causes the holder 43 to be moved to the second position Q2 after causing the sewing machine 1 to acquire the first position information. Compared to a case in which, after acquiring the first position Q1, the holder 43 cannot be automatically moved in the movement direction and by the movement distance before acquiring the second position information, the sewing machine 1 can increase a possibility that the holder 43 will be moved to the vicinity of the second position Q2 set by the user, and can improve convenience when the user causes the holder 43 to be moved to the second position Q2.

The sewing machine 1 according to the first and second embodiments is provided with the LCD 15. When the embroidery pattern E is re-shaped on the basis of the first position information and the second position information, the processor 2 displays the size of the re-shaped embroidery pattern EM on the LCD 15 (S59, S73). The user can confirm the side of the re-shaped embroidery pattern EM by referring to the LCD 15.

The processor 2 of the sewing machine 1 according to the first embodiment acquires the modifiable range of the embroidery pattern E acquired at S2 (S3). When the embroidery pattern E has been re-shaped on the basis of the first position information and the second position information, the processor 2 determines whether the modification amount of the re-shaped embroidery pattern EM is within the modifiable range (S53). When it is determined that the modification amount is not within the modifiable range (no at S53), the processor 2 causes the second position information to be re-acquired (S46 after S57). The sewing machine 1 can improve the possibility that the modification amount of the embroidery pattern EM re-shaped on the basis of the first position information and the second position information will be within the modifiable range.

When it is determined that the modification amount is not within the modifiable range (no at S53), the processor 2 of the sewing machine 1 according to the first embodiment generates the sewing data for sewing the embroidery pattern EM re-shaped on the basis of the first position information and the second position information such that the modification amount is within the modifiable range (S55, S17). The sewing machine 1 can cause the modification amount of the embroidery pattern EM re-shaped on the basis of the first position information and the second position information to be within the modifiable range. The sewing machine 1 can eliminate the time and effort for the user to re-set at least one selected from the group of the first position Q1 and the second position Q2.

The processor 2 of the sewing machine 1 according to the first embodiment sets the sewing position of the embroidery pattern E to a position in which the first reference point P1 is disposed at the position identified using the first position information and the second reference point P2 is disposed at the position identified using the second position information, respectively (S51). By moving the holder 43 to the first position Q1 and to the second position Q2, the user can set both the modification amount of the embroidery pattern E and the arrangement of the embroidery pattern E. Compared to a case in which the sewing position is not set on the basis of the first position information and the second position information, the sewing machine 1 can improve convenience for the user when sewing the re-shaped embroidery pattern EM using the design or the like of the sewing object C held by the embroidery frame 50 as the index.

The processor 2 according to the first embodiment calculates the angle of the vector V from the first position Q1 toward the second position Q2, with respect to the reference direction (S49). The processor 2 enlarges or reduces the size of the embroidery pattern E on the basis of the distance B1 identified at S47, and generates the sewing data for sewing the embroidery pattern EM re-shaped by rotating the embroidery pattern E by the angle calculated at S49 (S50, S17). By moving the holder 43 to the first position Q1 and to the second position Q2, the user can set the modification amount of the embroidery pattern E, and the sewing position and the angle of the embroidery pattern E. Compared to a case in which the angle of the embroidery pattern E is not set on the basis of the first position information and the second position information, the sewing machine 1 can improve convenience of the user when sewing the re-shaped embroidery pattern EM using the design or the like of the sewing object C held by the embroidery frame 50 as the index.

The processor 2 of the sewing machine 1 according to the first embodiment determines whether the distance B1 is equal to or larger than the predetermined value (S48). When it is determined that the distance B1 is not equal to or larger than the predetermined value (no at S48), the processor 2 causes the second position information to be re-acquired (S46 after S57). The sewing machine 1 can suppress the setting of the angle of the embroidery pattern E on the basis of the first position information and the second position information in which there is insufficient distance for setting the angle of the embroidery pattern E.

The processor 2 of the sewing machine 1 according to the second embodiment acquires the third position information indicating the position of the holder 43 when the holder 43 is in the third position Q3 that is different from the first position Q1 and the second position Q2 (S65 in FIG. 9). The processor 2 generates the sewing data for sewing the embroidery pattern EM re-shaped on the basis of the first position information, the second position information, and the third position information (S68 in FIG. 9, S17 in FIG. 3). By moving the holders 43 to the first position Q1, the second position Q2, and the third position Q3 in accordance with the design or the like of the sewing object C held by the embroidery frame 50, the user can cause the sewing machine 1 to acquire the first position information, the second position information, and the third position information. The sewing machine 1 can generate the sewing data for sewing the embroidery pattern EM re-shaped on the basis of the acquired first position information, second position information, and third position information. Compared to a case in which the sewing data is generated using two sets of position information, the sewing machine 1 can improve convenience for the user when re-shaping the embroidery pattern E using the design or the like of the sewing object C held by the embroidery frame 50 as the index.

The processor 2 of the sewing machine 1 according to the second embodiment sets the reference graphic W on the basis of the first position information, the second position information, and the third position information (S66). The processor 2 generates the sewing data for sewing the embroidery pattern EM re-shaped in accordance with the set reference graphic W (S68, S17). By moving the holder 43 to the first position Q1, the second position Q2, and the third position Q3 in accordance with the design or the like of the sewing object C held by the embroidery frame 50, the user can set the reference graphic W in accordance with the design or the like of the sewing object C. Compared to a case in which the embroidery pattern E is not re-shaped in accordance with the reference graphic W, the sewing machine 1 can improve convenience for the user when re-shaping the embroidery pattern E using the design or the like of the sewing object C held by the embroidery frame 50 as the index.

The sewing machine according to the present disclosure is not limited to the above-described embodiments, and various modifications may be added insofar as they do not depart from the gist and scope of the present disclosure. For example, the following modifications may be added as appropriate.

(A) The configuration of the sewing machine 1 on which the embroidery frame 50 can be mounted may be changed as appropriate. The sewing machine 1 may be an industrial sewing machine or may be a multi-needle sewing machine. It is sufficient that the movement portion 40 be able to move the holder 43 relative to the needle bar 6. The movement portion 40 may be integrally formed with the sewing machine 1. The shape and size of the embroidery frame 50 may be changed as appropriate, and the embroidery frame 50 may be a circular shape, an elliptical shape or the like. The sewing machine 1 according to the second embodiment may omit at least one selected from the group of the projector 58, the LCD 15, and the touch panel 26. The sewing machine 1 according to the first embodiment may be provided with an illumination device, such as a laser pointer or the like, in place of the projector 58. An arrangement position of the projector 58, and the projection area B and the like may be changed as appropriate. in place of the touch panel 26, the input portion may be a keyboard, a mouse, a joystick and the like. It is sufficient that the display portion be able to display images, and the display portion may be an organic EL display, a plasma display, a plasma tube array display, an electronic paper display using electrophoresis, or the like.

(B) The program including the commands for executing the main processing shown in FIG. 3 may be stored in a storage device of the sewing machine 1 until the processor 2 executes the program. Thus, an acquisition method of the program, an acquisition routed, and the device that stores the program may each be changed as appropriate. The program executed by the processor 2 may be received from another device via a cable or wireless communication, and may be stored in a storage device, such as a flash memory. Examples of the other device include a PC and a server connected via a network.

(C) The respective steps of the main processing executed by the sewing machine 1 are not limited to the example in which they are executed by the processor 2, and a part or all of the steps may be executed by another electronic device (an ASIC, for example). The respective steps of the main processing may be executed through distributed processing by a plurality of electronic devices (a plurality of CPUs, for example). The respective steps of the main processing can be changed in order, omitted or added, as necessary. An aspect in which an operating system (OS) or the like operating on the sewing machine 1 executes a part or all of the main processing on the basis of a command from the processor 2 is also included in the scope of the present disclosure. For example, the following modifications (C-1) to (C-5) may be added to the main processing, as appropriate.

(C-1) In the main processing according to the first embodiment, the processing at S5 may be changed as appropriate. The processor 2 may omit S21 to S23, and a configuration may be adopted in which the re-shaping method cannot be set. The range in which the first reference point and the second reference point can be set may be changed as appropriate. At least one selected from the group of the first reference point and the second reference point may be set at a desired position on the mask M or inside the mask M, or may be set at a desired position outside the mask M. When an embroidery pattern of the alphabetic character O is acquired at S2, for example, the processor 2 may set at least one selected from the group of the first reference point and the second reference point in a portion surrounded by stitches at which the stitches are not formed, such as the central portion of the O. The processor 2 may set an offset area on the outside of the mask M, namely, on the opposite side from the center of the embroidery pattern, on the basis of the offset amount acquired at S9, and may set at least one selected from the group of the first reference point and the second reference point inside the set offset area. The setting method of the first reference point and the second reference point may be changed as appropriate. A configuration may be adopted in which at least one selected from the group of the first reference point and the second reference point cannot be set by the user, or a configuration may be adopted in which at least one selected from the group of the first reference point and the second reference point can be selected from among a plurality of candidates for the reference point. The acquisition method of the first position information, the second position information, and the third position information may be changed as appropriate. For example, the holder 43 and the embroidery frame 50 may be manually moved by the user, and in this case, the processor 2 may acquire the position of the holder 43 when the key 74 is pressed.

(C-2) In the main processing according to the first embodiment, the processing at S1 and S52 may be omitted as appropriate. The processing from S54 to S56 after S52 may be omitted as appropriate. The processing at S57 and S58 after S52 may be omitted as appropriate. The processing at S3 and S53 may be omitted as appropriate. The processing from S54 to S56 after S53 may be omitted as appropriate. The processing at S57 and S58 after S53 may be omitted as appropriate. The processor 2 may end the main processing after S58. The processor 2 may invalidate the first position information instead of the second position information at S57, and may cause the first position information to be re-acquired. The processor 2 may decide the position information to be re-acquired in accordance with a command instructing which of the first position information and the second position information is to be re-acquired. The processor 2 may omit S9, and may not be able to re-shape the embroidery pattern while taking the offset amount into account. The processor 2 may omit S7, S8, and 515. The processor 2 may omit S59 and S73. The processor 2 may omit S51 and S69. In other words, while the first position information, the second position information, and the third position information are used in the processing to re-shape the embroidery pattern, at least one selected from the group of the first position information, the second position information, and the third position information need not necessarily be used in setting the sewing position of the re-shaped embroidery pattern EM. For example, the processor 2 may enlarge or reduce the embroidery pattern in accordance with a ratio between the distance B1 calculated on the basis of the first position information and the second position information, and the distance B2 between the first reference point P1 and the second reference point P2 in the embroidery coordinate system. The processor 2 may omit S49, and need not necessarily rotate the embroidery pattern in accordance with the first position information and the second position information. The processor 2 may omit S48. At S45, the processor 2 may cause the holder 43 to be moved only in the second position range, and, when the holder 43 has moved outside the second position range, the processor 2 may issue a warning. When it is determined that the embroidery pattern EM re-shaped at S52 does not fit within the sewing area R (no at S52), using a known method, the processor 2 may divide the re-shaped embroidery pattern EM, and may generate the sewing data for sewing the divided embroidery pattern.

Figure 11:
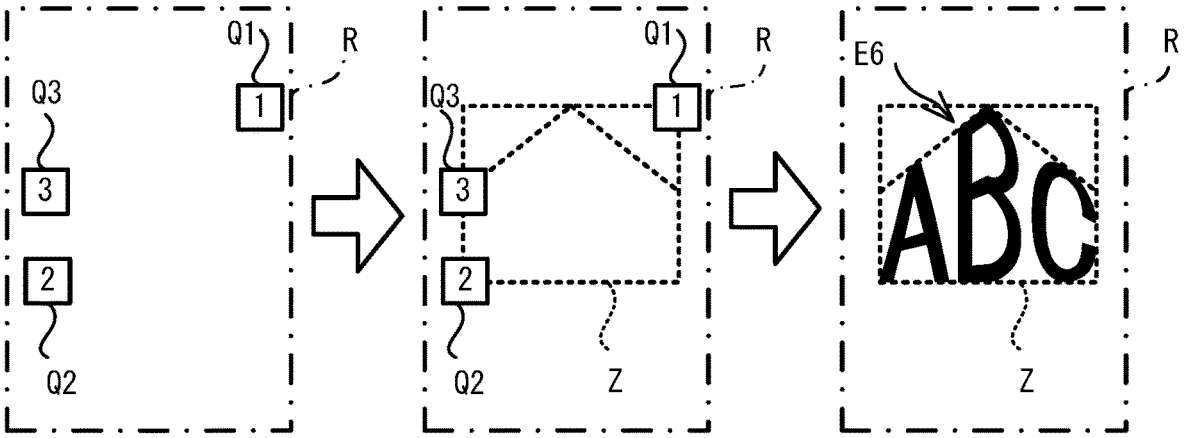
FIG. 11 is an explanatory diagram of a modified example in which a reference graphic is set on the basis of the first position, the second position, and a third position, and the embroidery pattern is re-shaped in accordance with the set reference graphic.

(C-3) In the main processing according to the second embodiment, a type and a setting method of the reference graphic set at S66 may be changed as appropriate. The reference graphic may be a graphic that is a polygonal shape, a circle, or an annular shape such as an ellipse, and the processor 2 may re-shape the embroidery pattern such that the embroidery pattern is disposed inside the reference graphic. For example, the processor 2 may re-shape the embroidery pattern along the reference graphic, as in a modified example shown in FIG. 11. As shown in FIG. 11, in a similar manner to the main processing according to the second embodiment, the processor 2 acquires the first position information, the second position information, and the third position information on the basis of the first position Q1, the second position Q2, and the third position Q3 with respect to the sewing area R. The processor 2 sets a pentagonal reference graphic Z that protrudes in the Y direction, that is, upward in FIG. 11, on the basis of the acquired first position information, second position information, and third position information. As the reference graphic Z, for example, after a rectangle is set whose opposing apexes are the needle drop points corresponding to each of the first position Q1 and the second position Q2, the pentagonal shape is set in accordance with the position of the needle drop point corresponding to the third position Q3 on the side, of the four sides included in the rectangle, that passes through the needle drop point corresponding to the first position Q1 and that extends in the Y direction. As shown by an embroidery pattern E6, the processor 2 re-shapes the embroidery pattern E such that the embroidery pattern E is disposed inside the reference graphic Z. The processor 2 may use opposing apexes of the mask M as the first reference point and the second reference point, and may set the size and the sewing position of the embroidery pattern using the corresponding first position information and second position information.

Figure 12:
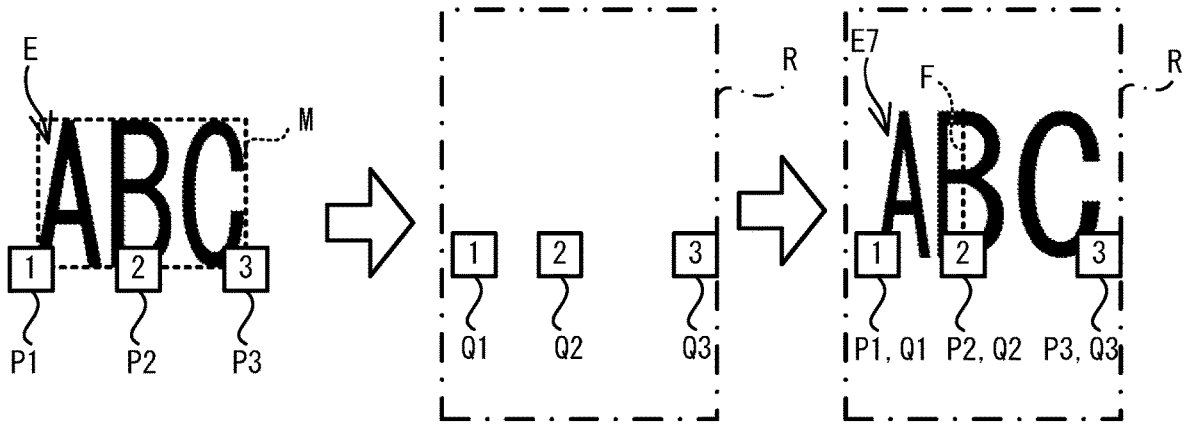
FIG. 12 is an explanatory diagram of a modified example in which the embroidery pattern is re-shaped without setting the reference graphic on the basis of the first position, the second position, and the third position.

(C-4) In the main processing according to the second embodiment, the processor 2 may omit S66, and may re-shape the embroidery pattern on the basis of the first position information, the second position information, and the third position information, without using the reference graphic. For example, the processor 2 may re-shape the embroidery pattern along a reference graphic as in a modified example shown in FIG. 12. As shown in FIG. 12, in a similar manner to the main processing according to the first embodiment, the processor 2 acquires the first reference point P1, the second reference point P2, and a third reference point P3. The first reference point P1, the second reference point P2, and the third reference point P3 are aligned on a side of the mask M extending in the X direction. The first reference point P1 is the lower left apex of the mask M. The third reference point P3 is the lower right apex of the mask M. The second reference point P2 is a point between the first reference point P1 and the third reference point P3. In a similar manner to the main processing according to the second embodiment, the processor 2 acquires the first position information, the second position information, and the third position information on the basis of the first position Q1, the second position Q2, and the third position Q3, with respect to the sewing area R. The needle drop points corresponding to each of the first position Q1, the second position Q2, and the third position Q3 are on the same straight line. The processor 2 enlarges or reduces the embroidery pattern E in the X direction and sets the sewing position of the embroidery pattern E such that the first reference point P1 is disposed at the first position Q1, the second reference point P2 is disposed at the second position Q2, and the third reference point P3 is disposed at the third position Q3, respectively. The processor 2 enlarges or reduces, in the X direction, a section on the left side of a line segment F, of the embroidery pattern E, that passes through the second reference point P2 and extends in the Y direction, such that a distance between the first reference point P1 and the second reference point P2 is the same as a distance between the needle drop points respectively corresponding to the first position Q1 and the second position Q2. The processor 2 enlarges or reduces, in the X direction, a section on the right side of the line segment F, such that a distance between the second reference point P2 and the third reference point P3 is the same as a distance between the needle drop points respectively corresponding to the second position Q2 and the third position Q3. In an embroidery pattern E7, a magnification in the X direction is different between a section on the left side of the line segment F and a section on the right side of the line segment F.

(C-5) A number of the reference points used in the processing to re-shape the embroidery pattern may be changed as appropriate, and may be four or more. A number of pieces of position information indicating the position of the holder 43 used in the processing to re-shape the embroidery pattern may be changed as appropriate, and may be four or more. The main processing according to the first embodiment and the main processing according to the second embodiment may be combined as appropriate insofar as no contradictions arise.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a sewing portion including a needle bar, the sewing portion being configured to form stitches on a sewing object by moving the needle bar up and down;

a movement portion including a holder on which an embroidery frame that holds the sewing object is detachably mounted, the movement portion being configured to move the holder with respect to the needle bar;

a processor configured to control the sewing portion and the movement portion; and a memory configured to store computer-readable instructions that, when executed by the processor, instruct the processor to perform processes comprising:

pattern acquisition processing of acquiring data relating to an embroidery pattern;

first position information acquisition processing of acquiring first position information indicating a position of the holder when the holder is in a first position, the first position information being represented by a coordinate system of the movement portion;

second position information acquisition processing of acquiring second position information indicating a position of the holder when the holder is in a second position different from the first position, the second position information being represented by the coordinate system of the movement portion;

generating processing of generating sewing data for sewing the embroidery pattern re-shaped on the basis of the first position information and the second position information, the sewing data indicating positions of a plurality of needle drop points using the coordinate system of the movement portion; and sewing control processing of controlling the sewing portion and the movement portion in accordance with the generated sewing data, and sewing the re-shaped embroidery pattern on the sewing object held by the embroidery frame.

2. The sewing machine according to claim 1, wherein the computer-readable instructions further instruct the processor to perform a process comprising:

distance identification processing of identifying a first distance between the first position and the second position, on the basis of the first position information and the second position information, and the generating processing includes generating the sewing data for sewing the embroidery pattern re-shaped by one of enlarging or reducing a size of the embroidery pattern on the basis of the identified first distance.

3. The sewing machine according to claim 2, wherein the computer-readable instructions further instruct the processor to perform a process comprising:

reference point acquisition processing of acquiring a first reference point and a second reference point set with respect to the embroidery pattern, and the generating processing includes generating the sewing data for sewing the embroidery pattern re-shaped by one of enlarging or reducing the embroidery pattern such that a second distance between the acquired first reference point and second reference point is the same as the first distance between the first position and the second position.

4. The sewing machine according to claim 3, further comprising:

a display portion; and an input portion configured to receive setting of the first reference point and the second reference point with respect to the embroidery pattern displayed on the display portion, wherein the reference point acquisition processing includes acquiring the first reference point and the second reference point set with respect to the embroidery pattern using the input portion.

5. The sewing machine according to claim 3, wherein each of the first reference point and the second reference point is set on the embroidery pattern.

6. The sewing machine according to claim 3, wherein the computer-readable instructions further instruct the processor to perform processes comprising:

direction decision processing of deciding a movement direction of the holder from the first position, on the basis of the first reference point and the second reference point set on the embroidery pattern; and movement control processing of controlling the movement portion, after acquiring the first position information and before acquiring the second position information, to move the holder in the decided movement direction.

7. The sewing machine according to claim 6, wherein the computer-readable instructions further instruct the processor to perform a process comprising distance decision processing of deciding a movement distance of the holder from the first position, on the basis of the first reference point and the second reference point set on the embroidery pattern, and the movement control processing includes moving the holder by the decided movement distance in the movement direction, after acquiring the first position information and before acquiring the second position information.

8. The sewing machine according to claim 3, wherein the computer-readable instructions further instruct the processor to perform a process comprising:

sewing position setting processing of setting a sewing position of the embroidery pattern to a position at which the first reference point is at a position identified using the first position information and the second reference point is at a position identified using the second position information, respectively.

9. The sewing machine according to claim 8, wherein the computer-readable instructions further instruct the processor to perform processes comprising:

distance determination processing of determining whether the first distance is equal to or greater than a predetermined value; and third acquisition processing of re-acquiring one of the first position information or the second position information, when it is determined that the first distance is not equal to or greater than the predetermined value.

10. The sewing machine according to claim 2, wherein the computer-readable instructions further instruct the processor to perform processes comprising:

area acquisition processing of acquiring a sewing area set inside the embroidery frame;

area determination processing of determining whether the re-shaped embroidery pattern fits within the sewing area, when the embroidery pattern has been re-shaped on the basis of the first position information and the second position information; and first acquisition control processing of causing one of the first position information or the second position information to be re-acquired, when it is determined that the re-shaped embroidery pattern does not fit within the sewing area.

11. The sewing machine according to claim 2, wherein the computer-readable instructions further instruct the processor to perform processes comprising:

area acquisition processing of acquiring a sewing area set inside the embroidery frame; and area determination processing of determining whether the re-shaped embroidery pattern fits within the sewing area, when the embroidery pattern has been re-shaped on the basis of the first position information and the second position information, and when it is determined that the re-shaped embroidery pattern does not fit within the sewing area, the generating processing includes generating the sewing data for sewing the embroidery pattern re-shaped on the basis of the first position information and the second position information such that the embroidery pattern fits within the sewing area.

12. The sewing machine according to claim 2, wherein the computer-readable instructions further instruct the processor to perform a process comprising:

offset amount acquisition processing of acquiring an offset amount, and the generating processing includes generating the sewing data for sewing the embroidery pattern re-shaped by one of enlarging or reducing the size of the embroidery pattern, on the basis of the first position information, the second position information, and the offset amount.

13. The sewing machine according to claim 2, further comprising:

a display portion, wherein the computer-readable instructions further instruct the processor to perform a process comprising:

display control processing of displaying, on the display portion, a size of the re-shaped embroidery pattern, when the embroidery pattern has been re-shaped on the basis of the first position information and the second position information.

14. The sewing machine according to claim 2, wherein the computer-readable instructions further instruct the processor to perform processes comprising:

modifiable amount acquisition processing of acquiring a modifiable range of the acquired embroidery pattern;

modification determination processing of determining whether a modification amount of the re-shaped embroidery pattern is within the modifiable range, when the embroidery pattern has been re-shaped on the basis of the first position information and the second position information; and second acquisition control processing of re-acquiring one of the first position information or the second position information, when it is determined that the modification amount is not within the modifiable range.

15. The sewing machine according to claim 2, wherein the computer-readable instructions further instruct the processor to perform processes comprising:

modifiable amount acquisition processing of acquiring a modifiable range of the acquired embroidery pattern; and modification determination processing of determining whether a modification amount of the re-shaped embroidery pattern is within the modifiable range, when the embroidery pattern has been re-shaped on the basis of the first position information and the second position information, and when it is determined that the modification amount is not within the modifiable range, the generating processing includes generating the sewing data for sewing the embroidery pattern re-shaped on the basis of the first position information and the second position information such that the modification amount is within the modifiable range.

16. The sewing machine according to claim 2, wherein the computer-readable instructions further instruct the processor to perform a process comprising:

angle calculation processing of calculating an angle of a vector from the first position toward the second position, with respect to a reference direction, and the generating processing includes generating the sewing data for sewing the embroidery pattern that has been re-shaped by one of enlarging or reducing a size of the embroidery pattern on the basis of the identified first distance and rotating the embroidery pattern by the calculated angle.

17. The sewing machine according to claim 1, wherein the computer-readable instructions further instruct the processor to perform a process comprising:

third position information acquisition processing of acquiring, when the holder is in a third position different from the first position and the second position, third position information indicating a position of the holder, and the generating processing includes generating the sewing data for sewing the embroidery pattern that has been re-shaped on the basis of the first position information, the second position information, and the third position information.

18. The sewing machine according to claim 17, wherein the computer-readable instructions further instruct the processor to perform a process comprising:

reference graphic setting processing of setting a reference graphic on the basis of the first position information, the second position information, and the third position information, and the generating processing includes generating the sewing data for sewing the embroidery pattern that has been re-shaped in accordance with the set reference graphic.

* * * * *